US007724229B2

(12) United States Patent
Yoshihara et al.

(10) Patent No.: US 7,724,229 B2
(45) Date of Patent: May 25, 2010

(54) LIQUID CRYSTAL DISPLAY DEVICE

(75) Inventors: Toshiaki Yoshihara, Kawasaki (JP); Tetsuya Makino, Kawasaki (JP); Shinji Tadaki, Kawasaki (JP); Hironori Shiroto, Kawasaki (JP); Yoshinori Kiyota, Kawasaki (JP); Shigeo Kasahara, Kawasaki (JP); Keiichi Betsui, Kawasaki (JP)

(73) Assignee: Fujitsu Limited, Kawasaki (JP)

( * ) Notice: Subject to any disclaimer, the term of this patent is extended or adjusted under 35 U.S.C. 154(b) by 684 days.

(21) Appl. No.: 11/296,774

(22) Filed: Dec. 7, 2005

(65) Prior Publication Data

US 2006/0092122 A1 May 4, 2006

Related U.S. Application Data

(63) Continuation of application No. PCT/JP03/09892, filed on Aug. 4, 2003.

(51) Int. Cl.
*G09G 3/36* (2006.01)

(52) U.S. Cl. ..... 345/97; 345/99

(58) Field of Classification Search ..... 345/87, 345/89, 94, 97, 99, 208, 690
See application file for complete search history.

(56) References Cited

U.S. PATENT DOCUMENTS 5,519,411 A * 5/1996 Okada et al. ..... 345/89
6,392,624 B1 * 5/2002 Yang et al. ..... 345/94
7,202,849 B2 * 4/2007 Hattori et al. ..... 345/99
7,499,012 B2 * 3/2009 Yoshihara et al. ..... 345/97
2003/0001813 A1 1/2003 Sekiguchi

FOREIGN PATENT DOCUMENTS

| | | | |
|---|---|---|---|
| JP | 8-101372 | | 4/1996 |
| JP | 11-119189 | | 4/1999 |
| JP | 2002-156620 | * | 5/2002 |
| WO | WO 01/53882 A1 | | 7/2001 |

OTHER PUBLICATIONS

Yoshihara et al.; "A Full-Color Video Rate FLC Display Based on a Time Domain Color Switching with a TFT Array"; 17th Int'l. Liquid Crystal Conference; p. 25; P1-74.

(Continued)

*Primary Examiner*—Sumati Lefkowitz
*Assistant Examiner*—Seokyun Moon
(74) *Attorney, Agent, or Firm*—Greer, Burns & Crain, Ltd.

(57) ABSTRACT

A voltage corresponding to desired image data is applied to a ferroelectric liquid crystal having a spontaneous polarization at a predetermined cycle to rewrite the displayed image (period A), and then, all voltages applied to the ferroelectric liquid crystal are removed (timing C) to retain the displayed image before the removal (period B). A gate selection period (voltage application period to the ferroelectric liquid crystal) $t_2$ before stopping the voltage application is set longer than a gate selection period (voltage application period to the ferroelectric liquid crystal) $t_1$ in the normal display. Increasing the voltage application period to the ferroelectric liquid crystal provides a sufficient response of the liquid crystal during the gate selection period, thereby realizing high memory ability.

2 Claims, 19 Drawing Sheets

OTHER PUBLICATIONS

Yoshihara et al.; "A Full-Color FLC Display Based on Field Sequential Color with TFTs"; AM-LCD '99 Digest of Technical Papers, p. 185.

Yoshihara et al.; "Invited Paper: A 254-ppi Full-color Video Rate TFT-LCD Based on Field Sequential Color and FLC Display".

Japanese Office Action mailed Apr. 21, 2009.

* cited by examiner (a)

(b)

(a)

(b)

LIQUID CRYSTAL DISPLAY DEVICE

This application is a continuation of PCT International Application No. PCT/JP2003/009892 which has an International filing date of Aug. 4, 2003, which designated the United States of America.

TECHNICAL FIELD

The present invention relates to a liquid crystal display device, and more particularly to an active-driven type liquid crystal display device having a memory display function using a liquid crystal having a spontaneous polarization.

BACKGROUND ART

Along with the recent development of so-called information-oriented society, electronic apparatuses, such as personal computers and PDA (Personal Digital Assistants), have been widely used. With the spread of such electronic apparatuses, portable apparatuses that can be used in offices as well as outdoors have been used, and there are demands for small-size and light-weight of these apparatuses. Liquid crystal display devices are widely used as one of the means to satisfy such demands. Liquid crystal display devices not only achieve small size and light weight, but also include an indispensable technique in an attempt to achieve low power consumption in portable electronic apparatuses that are driven by batteries.

The liquid crystal display devices are mainly classified into the reflection type and the transmission type. In the reflection type liquid crystal display devices, light rays incident from the front face of a liquid crystal panel are reflected by the rear face of the liquid crystal panel, and an image is visualized by the reflected light, whereas in the transmission type liquid crystal display devices, the image is visualized by the transmitted light from a light source (backlight) placed on the rear face of the liquid crystal panel. Since the reflection type liquid crystal display devices have poor visibility because the reflected light amount varies depending upon environmental conditions, transmission type color liquid crystal display devices using color filters are generally used as display devices of personal computers for displaying multi-color or full-color images.

As the color liquid crystal display devices, TN (Twisted Nematic) type using switching elements such as a TFT (Thin Film Transistor) are widely used. Although the TFT-driven TN type liquid crystal display devices have better display quality, compared to STN (Super Twisted Nematic) type liquid crystal display devices, they require a backlight with high brightness to achieve high screen brightness because the light transmittance of the liquid crystal panel is only several percent or so at present. For this reason, a lot of power is consumed by the backlight. Moreover, since a color display is achieved using color filters, a single pixel needs to be composed of three sub-pixels, and there are problems that it is difficult to provide a high-resolution display, and the purity of the displayed colors is not sufficient.

In order to solve such problems, the present inventors developed field-sequential type liquid crystal display devices, (see, for example, T. Yoshihara, et. al., ILCC 98, P1-074, 1998; T. Yoshihara, et. al., AM-LCD '99 Digest of Technical Papers, p. 185, 1999; and T. Yoshihara, et. al., SID '00 Digest of Technical Papers, p. 1176, 2000, and the like). Such field-sequential type liquid crystal display devices do not require sub-pixels, and therefore, displays with higher resolution can be easily realized compared to color-filter type liquid crystal display devices. Moreover, since a field-sequential type liquid crystal display device can use the color of light emitted by the light source as it is for display without using a color filter, the displayed color has excellent purity. Furthermore, since the light utilization efficiency is high, a field-sequential type liquid crystal display device has the advantage of low power consumption. However, in order to realize a field-sequential type liquid crystal display device, high-speed responsiveness (2 ms or less) of liquid crystal is essential.

In order to provide a field-sequential type liquid crystal display device with significant advantages as mentioned above or increase the speed of response of a color-filter type liquid crystal display device, the present inventors are conducting research and development on the driving of liquid crystals such as a ferroelectric liquid crystal having spontaneous polarization, which may achieve 100 to 1000 times faster response compared to a prior art, by a switching element such as a TFT (for example, Japanese Patent Application Laid-Open No. 11-119189/1999, and the like). In the ferroelectric liquid crystal, the long-axis direction of the liquid crystal molecules tilts with the application of voltage. A liquid crystal panel sandwiching the ferroelectric liquid crystal therein is sandwiched by two polarization plates whose polarization axes are orthogonal to each other, and the intensity of the transmitted light is changed using birefringence caused by the change in the long-axis direction of the liquid crystal molecules.

As described above, the field-sequential type liquid crystal display device has higher light utilization efficiency and can reduce power consumption compared to the color-filter type liquid crystal display device. However, a further reduction in power consumption is required for portable apparatuses that are driven by batteries. Similarly, color-filter type liquid crystal display devices are required to reduce power consumption.

The following description will explain the display function, particularly a memory display function of a liquid crystal display device using a ferroelectric liquid crystal having a spontaneous polarization or the like. Such a liquid crystal display device has a normal display function that rewrites the displayed image at a predetermined cycle by applying a voltage to the liquid crystal, and a memory display function that stops the application of voltage to the liquid crystal and retains the image displayed before stopping the application of voltage. In the memory display function, after removing all voltages applied to the liquid crystal by switching elements such as TFT, the display state just before the removal of applied voltage is substantially retained, and therefore it is possible to display the image without applying a voltage to the liquid crystal material, thereby being capable of significantly reducing power consumption. Thus, such a liquid crystal display device is applicable to portable apparatuses, and has a significant effect of reducing power consumption, especially on portable apparatuses that often display still images.

The memory function of the ferroelectric liquid crystal having a spontaneous polarization is described below. A voltage is applied to a liquid crystal panel, and then the voltage is removed by stopping the application of voltage. The light transmittance during the application of voltage and the light transmittance at 60 seconds after the removal of the voltage are measured while changing the value of the applied voltage, and one example of the measurement results is shown in FIG. 1. FIG. 1 shows the measurement results by plotting the applied voltage (V) on the abscissa and the light transmittance (%) on the ordinate, wherein O-O represents the light transmittance during the application of voltage, and Δ-Δ represents the light transmittance at 60 seconds after the removal of the voltage. The corresponding applied voltage-light transmittance characteristics does not change even after the removal of applied voltage, and thus it can be understood that even when the voltage applied to the liquid crystal panel is removed, the light transmittance corresponding to the display state when the voltage is applied is maintained. Moreover, a black image (light transmittance: substantially 0%, applied voltage: substantially 0 V) shows no change during the application of voltage and the absence of applied voltage, and the display state is retained.

For the liquid crystal panel, a change in the light transmittance after removal of voltage is measured with time, and the measurement results are shown in FIG. 2. As shown in FIG. 2(*a*), a 5V, 100 μs pulse wave voltage is applied to the liquid crystal panel, and the light transmittance is measured with time. FIG. 2(*b*) shows the measured light transmittance by plotting the time (ms) on the abscissa and the light transmittance (arbitrary unit) on the ordinate. It can be understood that the light transmittance increases abruptly at the moment the voltage is applied and then attenuates gradually, but the attenuation is not seen 100 ms after the removal of voltage and the liquid crystal panel maintains a certain light transmittance.

It can be understood from the above description that the ferroelectric liquid crystal has the memory function, and even when the applied voltage is removed, the liquid crystal molecules maintain the previous state without moving from the stable position before the removal of the applied voltage to the other stable position. Thus, in a liquid crystal display device using a ferroelectric liquid crystal having such a memory function, when a voltage corresponding to the display information for one screen is applied once, a certain display corresponding to the applied voltage can be maintained without continuing the application of voltage, until a voltage corresponding to the display information for the next screen is applied. Consequently, it is possible to retain the display without applying the voltage, thereby enabling a reduction in power consumption.

DISCLOSURE OF THE INVENTION

The present invention has been made under the above circumstances, and it is an object of the present invention to provide a liquid crystal display device capable of reducing power consumption.

Another object of the present invention is to provide a liquid crystal display device capable of realizing sufficient liquid crystal response and high memory ability.

Still another object of the present invention is to provide a liquid crystal display device capable of realizing high memory ability in a wide temperature range.

A liquid crystal display device according to a first aspect of the invention comprises a liquid crystal material sealed in a gap formed by at least two substrates; and switching elements corresponding to respective pixels, for controlling selection/non-selection of voltage application to control light transmittance of the liquid crystal material, and has a first display function that displays an image by applying a voltage to the liquid crystal material through the switching elements, and a second display function that stops the application of voltage to the liquid crystal material through the switching elements and retains a display state just before the application of voltage is stopped, wherein a selection period of the switching elements just before the stop of the application of voltage for executing the second display function is longer than a selection period of the switching elements in the first display function.

In the liquid crystal display device according to the first aspect, the selection period (the time for applying a voltage to the liquid crystal material) of the switching elements by the data writing scanning for executing the memory display just before the stop of the application of voltage is set longer than the selection period (the time for applying a voltage to the liquid crystal material) of the switching elements in the normal display. Upon performing the memory display, the selection period (the time in which the gate is turned on in case where the switching elements are TFTs) of the switching elements is increased to increase the time for applying a voltage to the liquid crystal material, whereby the liquid crystal sufficiently responds in the selection period to thereby realize high memory ability. In case where the responsiveness of the liquid crystal is deteriorated under a low-temperature environment, in particular, sufficient memory ability cannot be provided by the selection period of the switching elements upon the normal display; however, increasing the selection period to increase the time for applying a voltage can provide sufficient memory ability even under the low-temperature environment.

A liquid crystal display device according to a fourth aspect of the invention comprises a liquid crystal material sealed in a gap formed by at least two substrates; and switching elements corresponding to respective pixels, for controlling selection/non-selection of voltage application to control light transmittance of the liquid crystal material, and has a first display function that displays an image by applying a voltage to the liquid crystal material through the switching elements, and a second display function that stops the application of voltage to the liquid crystal material through the switching elements and retains a display state just before the application of voltage is stopped, wherein a non-selection period of the switching elements just before the stop of the application of voltage for executing the second display function is longer than a non-selection period of the switching elements in the first display function.

In the liquid crystal display device according to the fourth aspect, the non-selection period (the time in which the gate is turned off in case where the switching elements are TFTs) of the switching elements by the data writing scanning for executing the memory display just before the stop of the application of voltage is set longer than the non-selection period (Off period of the gate) of the switching elements in the normal display. Upon performing the memory display, the non-selection period (OFF period of the gate) of the switching elements is increased to increase the time when the liquid crystal material can respond to an electric field, whereby the liquid crystal sufficiently responds in the non-selection period to thereby realize high memory ability. In case where the responsiveness of the liquid crystal is deteriorated under a low-temperature environment, in particular, sufficient memory ability cannot be provided by the non-selection period of the switching elements upon the normal display, however, increasing the non-selection period to increase the time for applying voltage can provide sufficient memory ability even under the low-temperature environment.

According to a liquid crystal display device of a second aspect of the invention, in the first aspect, all pixels are caused to display black image before resuming the application of voltage to the liquid crystal material to return to the first display function from the second display function.

According to a liquid crystal display device of a fifth aspect of the invention, in the fourth aspect, all pixels are caused to display black image before resuming the application of voltage to the liquid crystal material to return to the first display function from the second display function.

In the liquid crystal display device of the second aspect or fifth aspect, when resuming the application of voltage to the liquid crystal material, first, all pixels are caused to display black image, and then a voltage corresponding to data to be displayed is applied to the liquid crystal material. Therefore, a black-base image is definitely shown after resuming the application of voltage, and a clear image is obtained. If all pixels are not caused to display black image once when resuming the application of voltage, a problem occurs. For example, if the image that is retained during the absence of voltage is an image other than black image, especially a white image, a white-base image is shown when the application of voltage is started, and a desired image cannot be obtained.

According to a liquid crystal display device of a third aspect of the invention, in the second aspect, the selection period of the switching elements upon causing all pixels to display black image is longer than the selection period of the switching elements in the first display function.

According to a liquid crystal display device of a sixth aspect of the invention, in the fifth aspect, the non-selection period of the switching elements upon causing all pixels to display black image is longer than the non-selection period of the switching elements in the first display function.

In the liquid crystal display device according to the third aspect or the sixth aspect, upon causing pixels to display black image when resuming the application of voltage to the liquid crystal material, the selection period (the time for applying a voltage to the liquid crystal material) of the switching elements by the black data writing scanning or the non-selection period (OFF period of the gate) of the switching elements by the black data writing scanning is set longer than the selection period (the time for applying a voltage to the liquid crystal material) of the switching elements upon the normal display or the non-selection period (OFF period of the gate) of the switching elements upon the normal display. Accordingly, all pixels are surely caused to display black image.

A liquid crystal display device according to a seventh aspect of the invention comprises a liquid crystal material sealed in a gap formed by at least two substrates; and switching elements corresponding to respective pixels, for controlling selection/non-selection of voltage application to control light transmittance of the liquid crystal material, and has a first display function that displays an image by applying a voltage to the liquid crystal material through the switching elements, and a second display function that stops the application of voltage to the liquid crystal material through the switching elements and retains a display state just before the application of voltage is stopped, wherein an image display is performed by carrying out a switching between a first driving system in which a selection period of the switching elements just before the stop of the application of voltage for executing the second display function is longer than a selection period of the switching elements in the first display function and a second driving system in which the selection period of the switching elements just before the stop of the application of voltage for executing the second display function is equal to the selection period of the switching elements in the first display function.

In the liquid crystal display device according to the seventh aspect, the switching is made between the first driving system in which the selection period (the time for applying a voltage to the liquid crystal material) of the switching elements by the data writing scanning for executing the memory display just before the stop of the application of voltage function is longer than the selection period (the time for applying a voltage to the liquid crystal material) of the switching elements in the normal display and the second driving system in which the selection period (the time for applying a voltage to the liquid crystal material) of the switching elements by the data writing scanning for executing the memory display just before the stop of the application of voltage is equal to the selection period (the time for applying a voltage to the liquid crystal material) of the switching elements in the normal display.

A liquid crystal display device according to an eighth aspect of the invention comprises a liquid crystal material sealed in a gap formed by at least two substrates; and switching elements corresponding to respective pixels, for controlling selection/non-selection of voltage application to control light transmittance of the liquid crystal material, and has a first display function that displays an image by applying a voltage to the liquid crystal material through the switching elements, and a second display function that stops the application of voltage to the liquid crystal material through the switching elements and retains a display state just before the application of voltage is stopped, wherein an image display is performed by carrying out a switching between a first driving system in which a non-selection period of the switching elements just before the stop of the application of voltage for executing the second display function is longer than a non-selection period of the switching elements in the first display function and a second driving system in which the non-selection period of the switching elements just before the stop of the application of voltage for executing the second display function is equal to the non-selection period of the switching elements in the first display function.

In the liquid crystal display device according to the eighth aspect, the switching is made between the first driving system in which the non-selection period (OFF period of the gate) of the switching elements by the data writing scanning for executing the memory display just before the stop of the application of voltage is longer than the non-selection period (OFF period of the gate) of the switching elements in the normal display and the second driving system in which the non-selection period (OFF period of the gate) of the switching elements by the data writing scanning for executing the memory display just before the stop of the application of voltage is equal to the non-selection period (OFF period of the gate) of the switching elements in the normal display.

In the liquid crystal display device according to the seventh aspect or eighth aspect, in case where high memory ability cannot be provided by the selection period or the non-selection period of the switching elements equal to that in the normal display, the driving system is changed to the first driving system to make it possible to realize high memory ability, while, in case where high memory ability can be provided by the selection period or the non-selection period of the switching elements equal to that in the normal display, the driving system is changed to the second driving system to make it possible to reduce power consumption.

A liquid crystal display device according to a ninth aspect of the invention comprises, in the seventh or eighth aspect, measuring means for measuring a temperature of the liquid crystal display material and means for controlling the switching between the first driving system and the second driving system according to the measured results of the measuring means.

The liquid crystal display device according to the ninth aspect controls the switching between the first driving system and the second driving system according to the temperature of the liquid crystal material. Accordingly, it performs a switching to the first driving system in a low-temperature environment, thereby realizing high memory ability. Further, in a high-temperature environment that does not require the switching to the first driving system, it executes the second driving system to reduce power consumption.

The present invention is applicable to a field-sequential type liquid crystal display device in which lights of plural colors are changed with time, and to a color-filter type liquid crystal display device using a color filter. In the former field-sequential type liquid crystal display device, it is therefore possible to realize a color display having high-resolution, high color purity and high-speed response, while a color display can easily be performed in the latter color-filter type liquid crystal display device.

Further, the present invention is applicable to any one of a transmission type liquid crystal display device, reflection type liquid crystal display device and semi-transmission type liquid crystal display device. If the liquid crystal display device is of transmission type, the memory display can reduce power consumption, but the semi-transmission type or reflection type liquid crystal display device can further reduce power consumption.

Preferably, a monostable or bistable ferroelectric liquid crystal, especially a bistable ferroelectric liquid crystal is used in the liquid crystal display device of the present invention as the liquid crystal material. A stable memory display can be provided by using such a liquid crystal.

The liquid crystal display device of the present invention preferably comprises a mechanism for stopping the voltage application to the liquid crystal material at a desired timing. With this mechanism, a stable memory display is possible even in a liquid crystal display device performing a display by a line scanning. In case where the liquid crystal display device is of a type using a ferroelectric liquid crystal with the use of switching elements, in particular, the liquid crystal has a half-V-shaped electro-optic response characteristics (wherein, when voltage of one polarity is applied, it shows high light transmittance, while, when voltage of the other polarity is applied, it shows low light transmittance that can be regarded as a black image). Therefore, in each sub-frame (in the case of the field-sequential type) or in each frame (in the case of the color-filter type), the data writing scanning by the voltage of one polarity and the voltage of the other polarity is performed two times or more. In the field-sequential type, it is preferable to make the polarity of the voltage in each writing scanning equal in all pixels. In the color-filter type, it is not always necessary to perform the writing scanning for all pixels with the voltage of the same polarity, but it is preferable to perform the writing scanning with the voltage of the same polarity upon the memory display. The voltage application is stopped at the desired timing after the writing scanning by the voltage of the polarity capable of realizing high light transmittance is completed and before the next writing scanning by the voltage of the other polarity is started, whereby a stable memory display can be realized.

In the liquid crystal display device according to the present invention, it is preferable to vary the intensity of the light source for the display in accordance with the display manner. Specifically, the output intensity of the light source such as a backlight is more reduced upon the memory display than upon the normal display. In case where the liquid crystal material having a half-V-shaped electro-optic response characteristics is used, a light transmittance approximately twice that upon the normal display can be obtained upon the memory display. Consequently, brightness equal to that upon the normal display can be realized upon the memory display, even if the output intensity of the light source is reduced, thereby reducing power consumption. Thus, the output intensity of the light source can be varied in accordance with the display manner, whereby a fine adjustment in the display brightness is possible, thereby being capable of reducing useless power consumption by the light source.

In the liquid crystal display device according to the present invention, a voltage corresponding to the image that is intended to be displayed after the stop of the voltage application is applied just before the voltage application to the liquid crystal material is stopped. Consequently, memory display data having display data different from the normal display can surely be written, thereby being capable of realizing a desired memory display.

BEST MODE FOR IMPLEMENTING THE INVENTION

The following description will specifically explain the present invention with reference to the drawings illustrating some embodiments thereof. Note that the present invention is not limited to the following embodiments.

Firstly explained is the optimum value of the length of the gate-on period (selection period of the switching elements) or gate-off period (non-selection period of the switching elements) just before the memory display, which is the feature of the present invention.

After washing two glass substrates each having a transparent electrode with a diameter of 15 mm, they were coated with polyimide and baked for one hour at 200° C. so as to form about 200 Å thick polyimide films on each transparent electrode. These polyimide films were rubbed with a rayon fabric, and an empty panel was produced by stacking these two glass substrates so that the rubbing directions are parallel and maintaining a gap therebetween by spacers made of silica having an average particle size of 1.6 μm. A ferroelectric liquid crystal material (for example, a material disclosed in A. Mochizuki, et. al.: Ferroelectrics, 133, 353 (1991)) comprising naphthalene-based liquid crystal as a main component was sealed in this empty panel so as to form a liquid crystal panel for evaluation. The magnitude of spontaneous polarization of the sealed ferroelectric liquid crystal material was 6 $nC/cm^2$.

Figure 3:
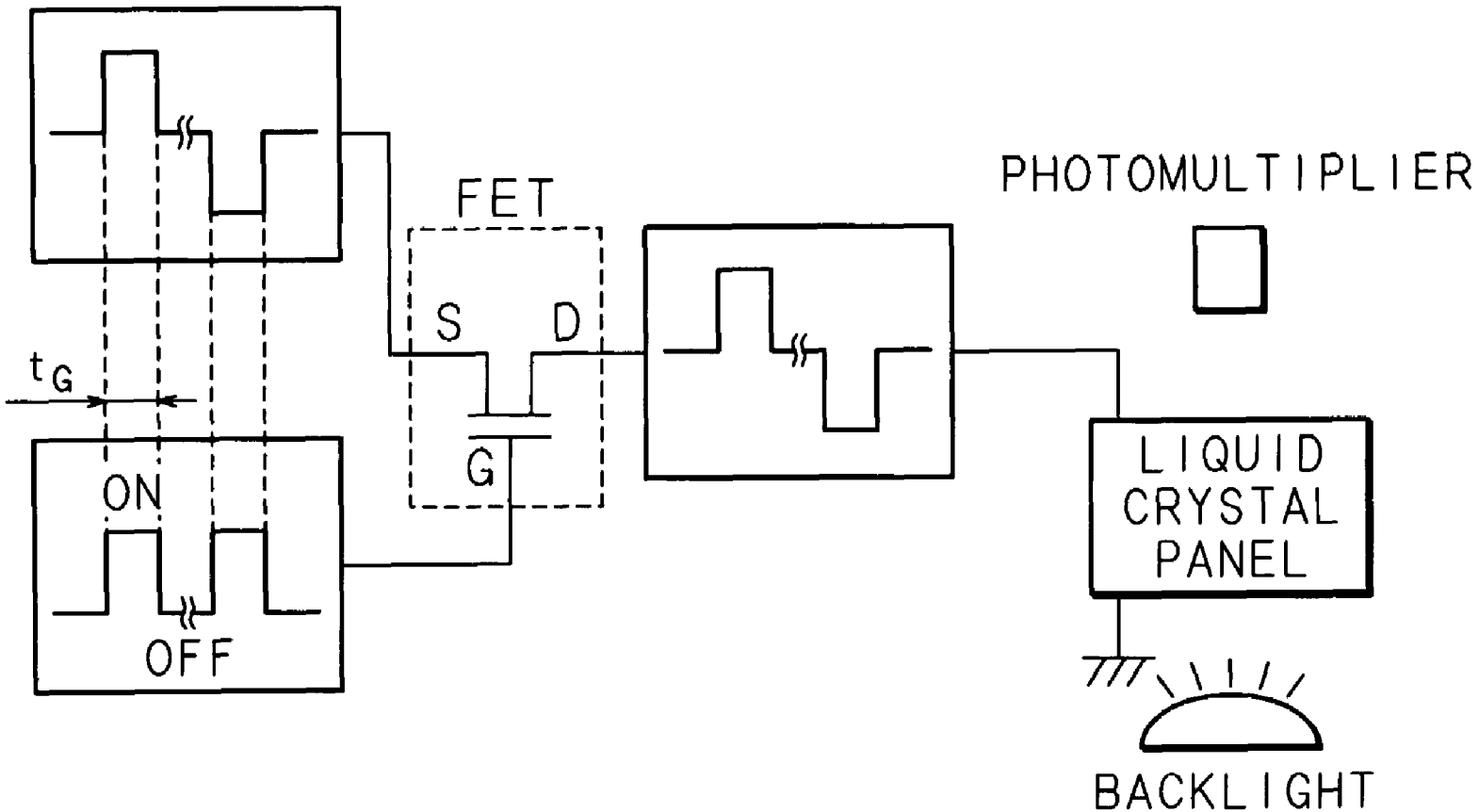
FIG. 3 is an illustration for explaining a pseudo-TFT drive of a liquid crystal panel for evaluation.

Then, the memory ratio of the fabricated liquid crystal panel was evaluated by using an evaluation apparatus shown in FIG. 3. Specifically, a pseudo-TFT drive in which a voltage was externally applied by FET switching was executed to the fabricated liquid crystal panel (composed of one liquid crystal cell), and the transmitted light through the liquid crystal panel from the backlight was detected by a photomultiplier, thereby evaluating a memory ratio of the liquid crystal panel. The memory ratio is defined as the ratio of the light transmittance at 60 seconds after the removal of the voltage to the transmittance (transmittance during the gate-off period) during when a voltage is applied.

Figure 4:
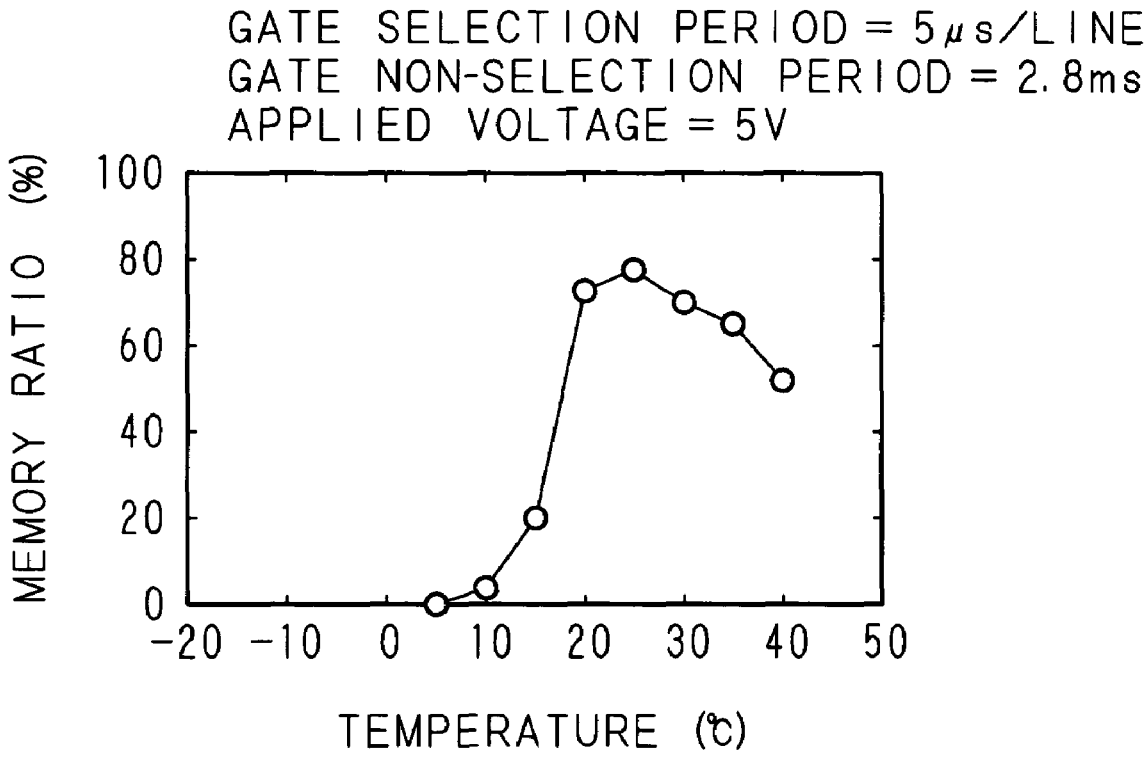
FIG. 4 is a graph showing a relationship between a memory ratio and a temperature.

FIG. 4 shows the relationship between the memory ratio and the temperature supposing that the gate selection period (gate-on) is 5 μs/line, the gate non-selection period (gate-off) is 2.8 ms and the applied voltage is +5 V The reason why the gate selection period is set to 5 μs/line is as follows. In order to realize a stable halftone display in the TFT drive of the ferroelectric liquid crystal, a short gate selection period such as not more than 5 to 10 μs/line is suitable. By setting the gate selection period to a short period of not more than 5 to 10 μs/line, a fast screen rewriting and stable halftone display can be realized. Specifically, the reason is that the gate selection period of the liquid crystal display device using the TFT-driven ferroelectric liquid crystal in the normal display is not more than 5 to 10 μs/line.

Further, the reason why the gate non-selection period (gate-off) is set to 2.8 ms is that the time for the sub-frame of each color of R, G and B in the field-sequential type is not more than 1/180 s, so that, in case where the data writing scanning is performed twice in the period of 1/180 s, the gate-off period of each line in each writing scanning becomes 1/360 s, i.e., 2.8 ms. Specifically, the reason is that the gate non-selection period of the liquid crystal display device using TFT-driven ferroelectric liquid crystal in the field sequential type upon the normal display is not more than 2.8 ms. It should be noted that the gate non-selection period upon the normal display in the color-filter type is not more than 8.3 ms.

It is understood from the results of FIG. 4 that, although high memory ratio such as 50% to 80% is shown within the temperature range of 20° C. to 40° C., the memory ratio rapidly decreases below 15° C. and the memory display cannot be performed.

Figure 5:
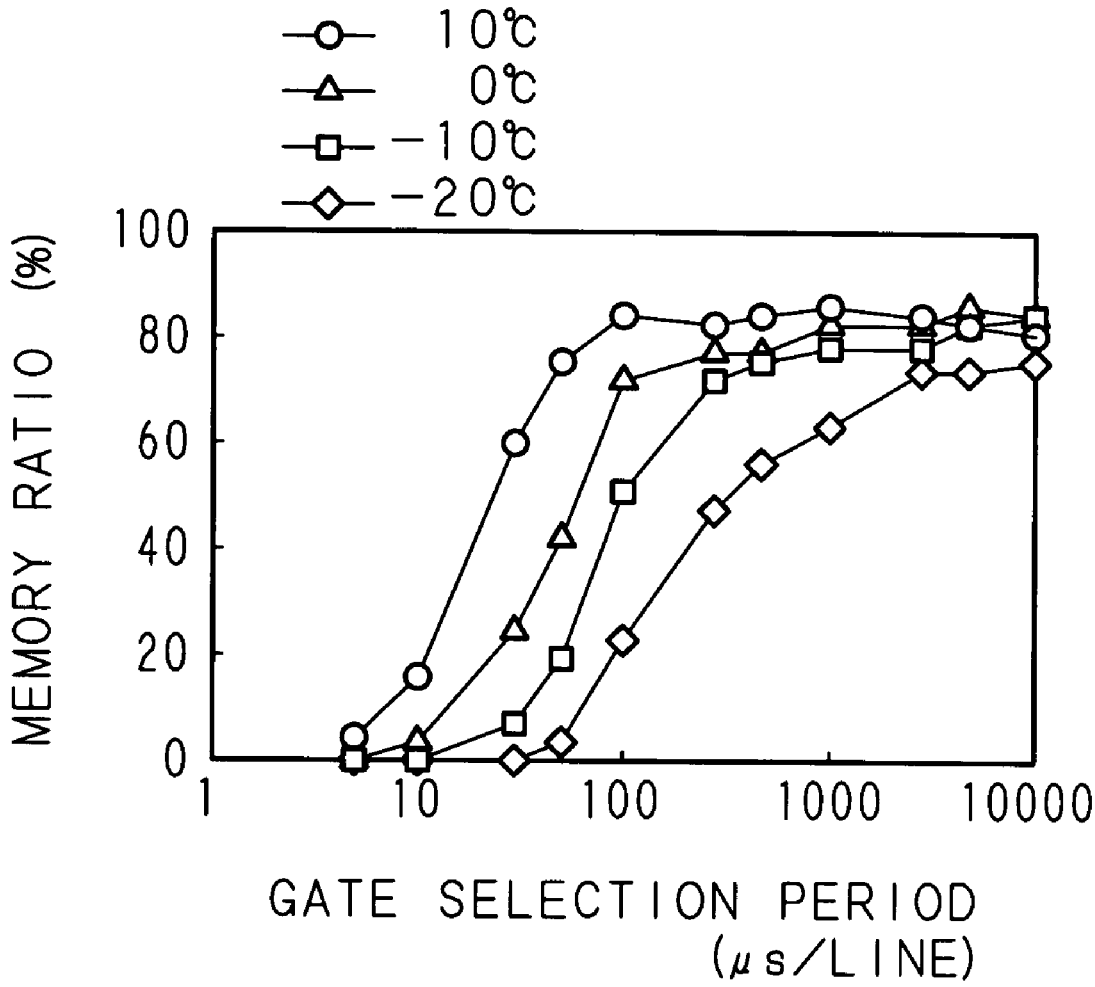
FIG. 5 is a graph showing a relationship between a memory ratio and a gate selection period.

Subsequently, the change in the memory ratio was measured, while changing the gate selection period (gate-on) under various temperature environments. FIG. 5 shows the measured results. It is understood from the results of FIG. 5 that high memory ratio is realized by increasing the gate selection period, and high memory ratio can be realized even at a low temperature of −20° C. This is because increasing the gate selection period enhances the responsiveness of the liquid crystal during the gate selection period, thereby being capable of compensating for the deterioration in the responsiveness of the liquid crystal caused with reduced temperature.

It is understood from the above that high memory ratio can be realized within a wide temperature range by increasing the gate selection period more than 5 to 10 μs/line that is the gate selection period upon the normal display, thereby being capable of providing a stable memory display. Upon performing the memory display, the gate selection period may always be increased from 5 to 10 μs/line, that is the gate selection period upon the normal display, regardless of the temperature, but it is understood from FIGS. 4 and 5 that whether the gate selection period is set longer or not with the temperature of 20° C. as a boundary may be set and the gate selection period may be set longer than 5 to 10 μs/line, that is the gate selection period upon the normal display, only at 20° C. or below.

Figure 6:
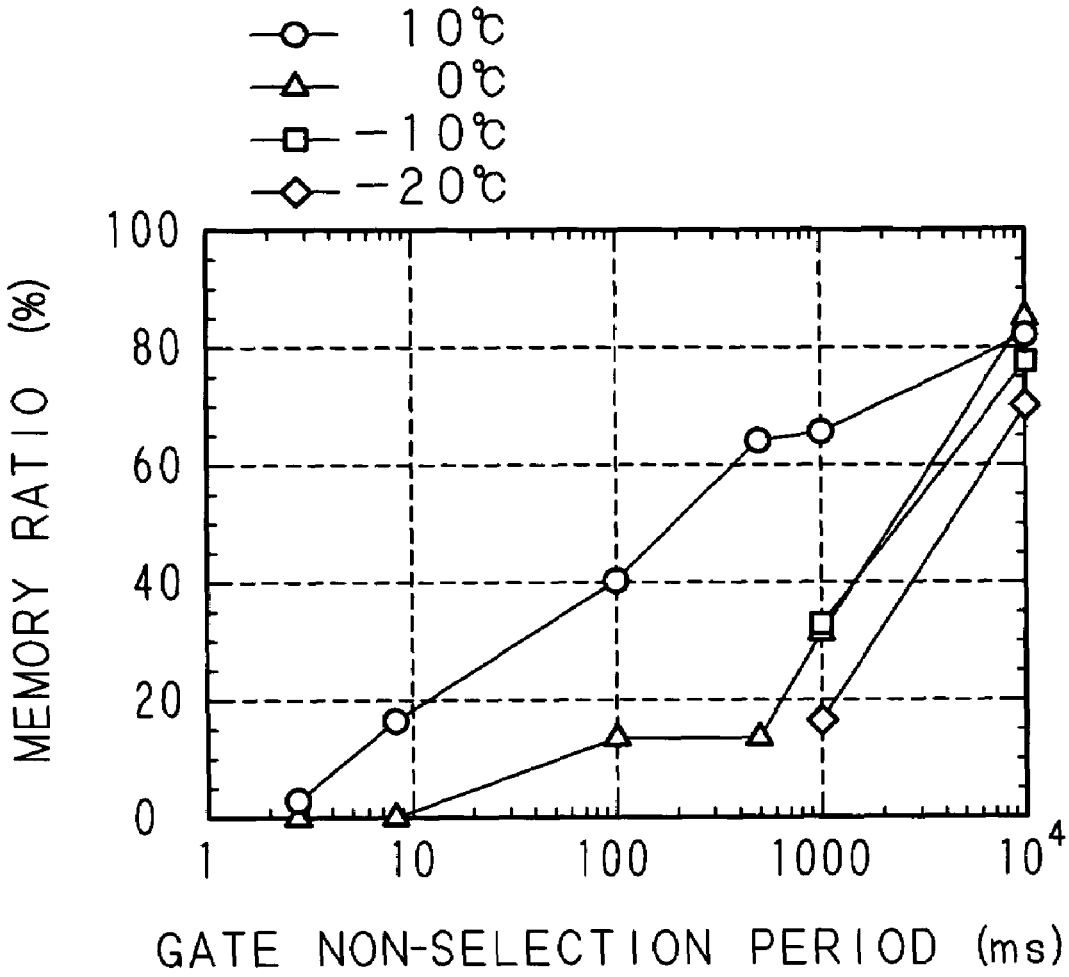
FIG. 6 is a graph showing a relationship between a memory ratio and a gate non-selection period.

Further, the change in the memory ratio was measured, while changing the non-gate selection period (gate-oft under various temperature environments. FIG. 6 shows the measured results. It is understood from the results of FIG. 6 that high memory ratio is realized by increasing the gate non-selection period, and high memory ratio can be realized even at a low temperature of −20° C. This is because increasing the gate non-selection period enhances the responsiveness of the liquid crystal during the gate non-selection period, thereby being capable of compensating for the deterioration in the responsiveness of the liquid crystal caused with reduced temperatures.

It is understood from the above that high memory ratio can be realized within a wide temperature range by increasing the gate non-selection period more than 2.8 ms that is the gate non-selection period upon the normal display, thereby being capable of providing a stable memory display. Upon performing the memory display, the gate non-selection period may always be increased from 2.8 ms, that is the gate non-selection period upon the normal display, regardless of the temperature, but it is understood from FIGS. 4 and 6 that whether the gate non-selection period is set longer or not with the temperature of 20° C. as a boundary may be set and the gate non-selection period may be set longer than 2.8 ms, that is the gate non-selection period upon the normal display, only at 20° C. or below.

Firstly, the example in which high memory ratio can surely be realized upon performing the memory display by setting the gate selection period (voltage application period to the liquid crystal) longer than that upon the normal display will be explained as the first and second embodiments.

First Embodiment

Figure 7:
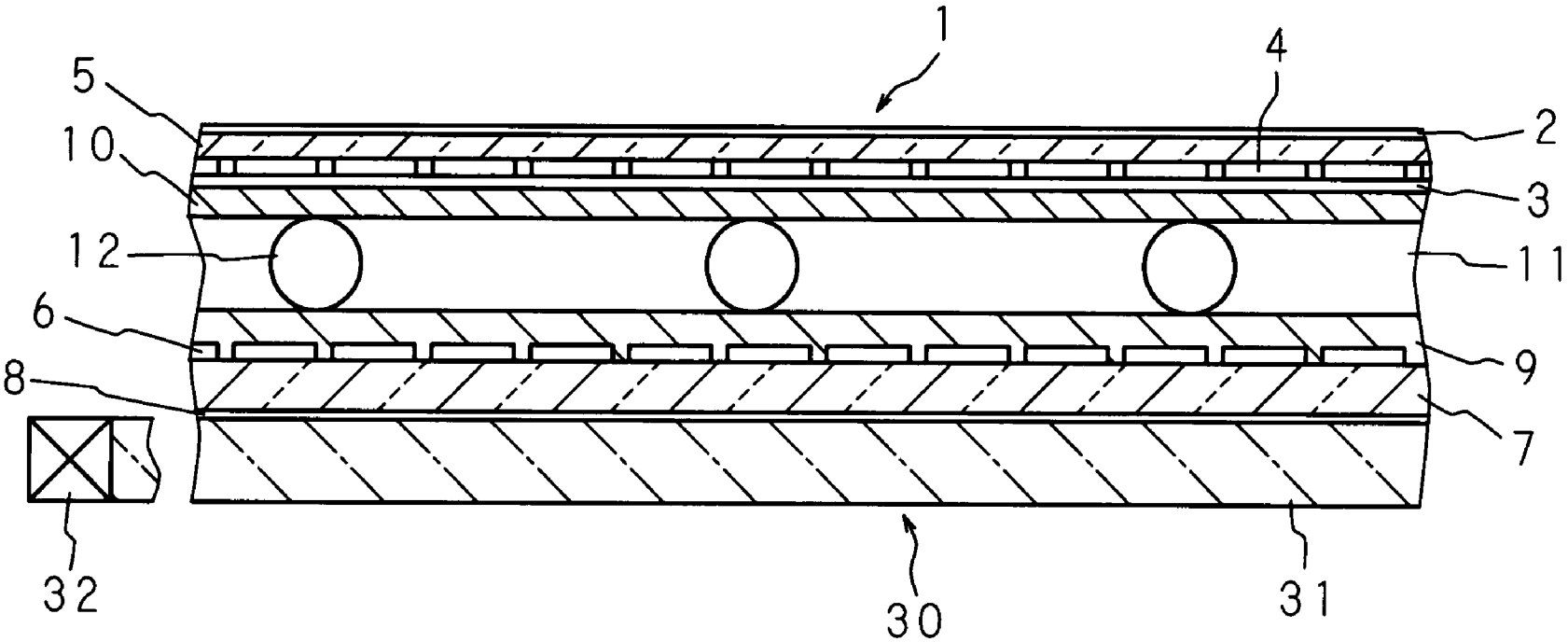
FIG. 7 is a schematic cross sectional view of a liquid crystal panel and backlight of the liquid crystal display devices of the first and third embodiments.
Figure 8:
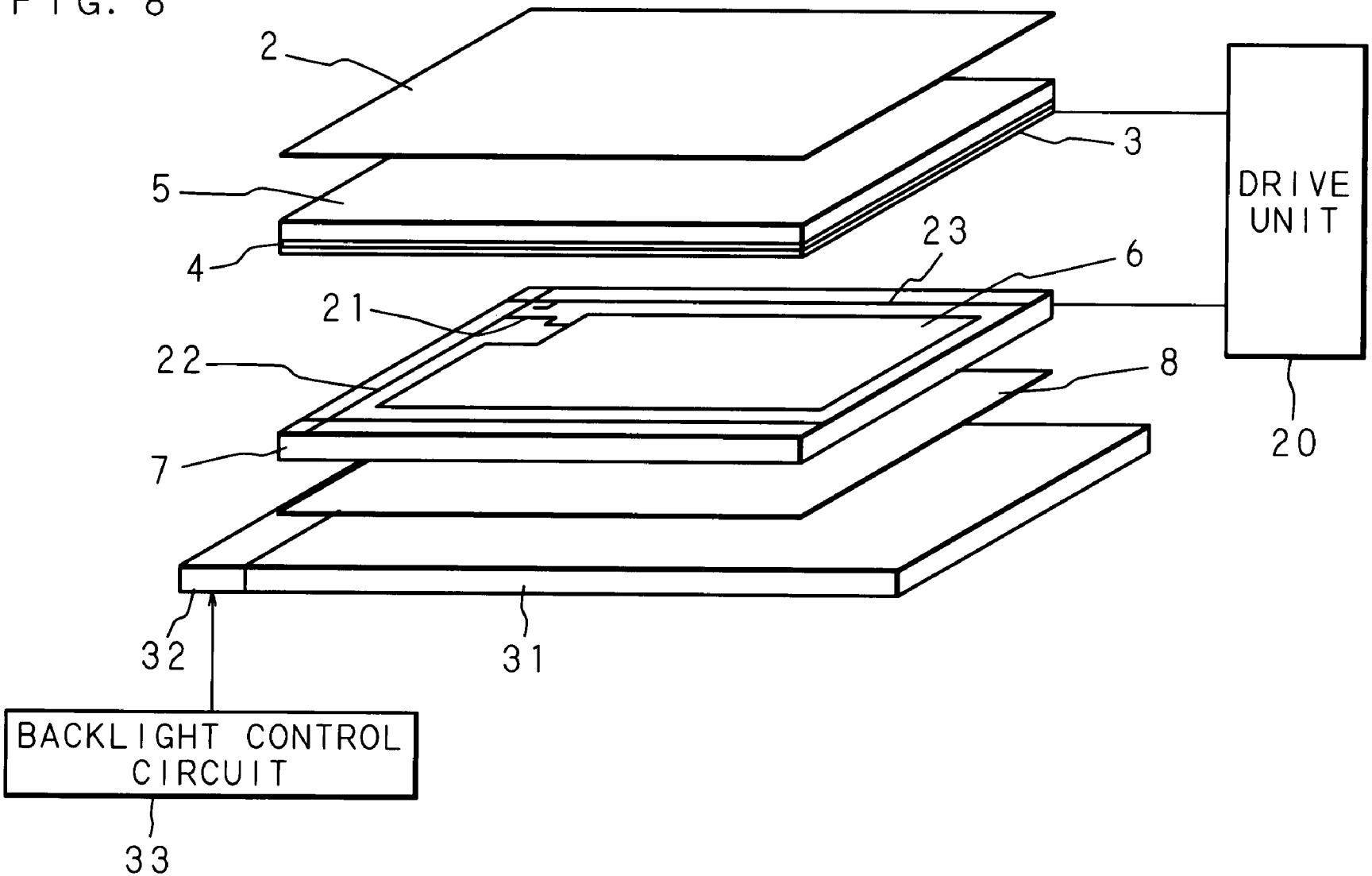
FIG. 8 is a schematic view showing an example of the overall structure of the liquid crystal display devices of the first and third embodiments.

FIG. 7 is a schematic cross sectional view of a liquid crystal panel 1 and a backlight 30 of the liquid crystal display device of the first embodiment, and FIG. 8 is a schematic view showing an example of the overall structure of the liquid crystal display device. The first embodiment shows a liquid crystal display device performing a color display with a color-filter system.

As shown in FIGS. 7 and 8, the liquid crystal panel 1 comprises a polarization film 2, a glass substrate 5 having a common electrode 3 and color filters 4 arranged in matrix form, a glass substrate 7 having pixel electrodes 6 which are arranged in matrix form and a polarization film 8, which are stacked in this order from the upper layer (front face) side to the lower layer (rear face) side.

A drive unit 20 comprising a data driver, a scan driver (not shown) and the like is connected between the common electrode 3 and the pixel electrodes 6. The data driver is connected to a TFT 21 through a signal line 22, while the scan driver is connected to the TFT 21 through a scanning line 23. The TFT 21 is controlled to be on/off by the scan driver. Moreover, each of the pixel electrodes 6 is controlled to be on/off by the TFT 21. Therefore, the intensity of transmitted light of each individual pixel is controlled by a signal given from the data driver through the signal line 22 and the TFT 21.

An alignment film 9 is provided on the upper face of the pixel electrode 6 on the glass substrate 7, while an alignment film 10 is placed on the lower face of the common electrode 3. The space between these alignment films 9 and 10 is filled with a liquid crystal material so as to form a liquid crystal layer 11. Note that the numeral 12 represents spacers for maintaining a layer thickness of the liquid crystal layer 11.

The backlight 30 is disposed on the lower layer (rear face) side of the liquid crystal panel 1, and has an LED array 32 placed to face an end face of a light guiding/diffusing plate 31 that forms a light emitting area for emitting white light. This LED array 32 has wide adjustment range of brightness, so that the adjustment of brightness is easy. The light guiding/diffusing plate 31 guides the white light emitted from each LED of this LED array 32 to its entire surface, and diffuses the white light to the upper face, thereby functioning as the light emitting area. It should be noted that a backlight control circuit 33 adjusts the turn-on or turn-off and the brightness of the backlight 30 (LED array 32).

A specific example of the liquid crystal display device according to the first embodiment will be explained. After washing a TFT substrate having pixel electrodes 6 (640×3 (RGB)×480, diagonal: 3.2 inches) and a common electrode substrate having a common electrode 3 and color filters 4 of RGB, they were coated with polyimide and baked for one hour at 200° C. so as to form about 200 Å thick polyimide films as alignment films 9 and 10.

Figure 9:
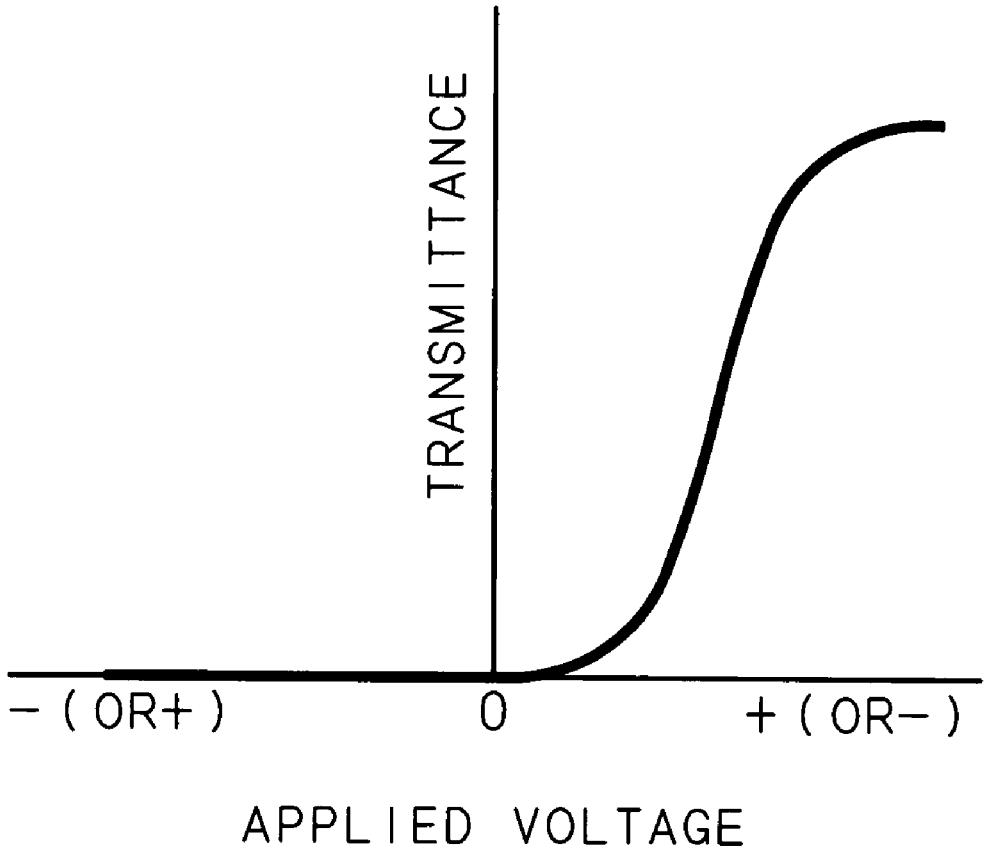
FIG. 9 is a graph showing electro-optic response characteristics of a ferroelectric liquid crystal.

Further, these alignment films 9 and 10 were rubbed with a rayon fabric, and an empty panel was produced by stacking these two substrates so as to maintain a gap therebetween by spacers 12 made of silica having an average particle size of 1.6 μm. A ferroelectric liquid crystal material (for example, a material disclosed in A. Mochizuki, et. al.: Ferroelectrics, 133, 353 (1991)) comprising a naphthalene-based liquid crystal as a main component and having half-V-shaped electro-optic response characteristics as shown in FIG. 9 during TFT driving was sealed in this empty panel so as to form a liquid crystal layer 11. The magnitude of spontaneous polarization of the sealed ferroelectric liquid crystal material was 6 $nC/cm^2$.

The liquid crystal panel 1 was produced by sandwiching the fabricated panel by two polarization films 2 and 8 arranged in a crossed-Nicol state, and a dark state is provided when the long-axis direction of the ferroelectric liquid crystal molecules is tilted in one direction. The liquid crystal panel 1 and the backlight 30 were stacked with each other to make it possible to perform a color display with a color-filter system.

Figure 10:
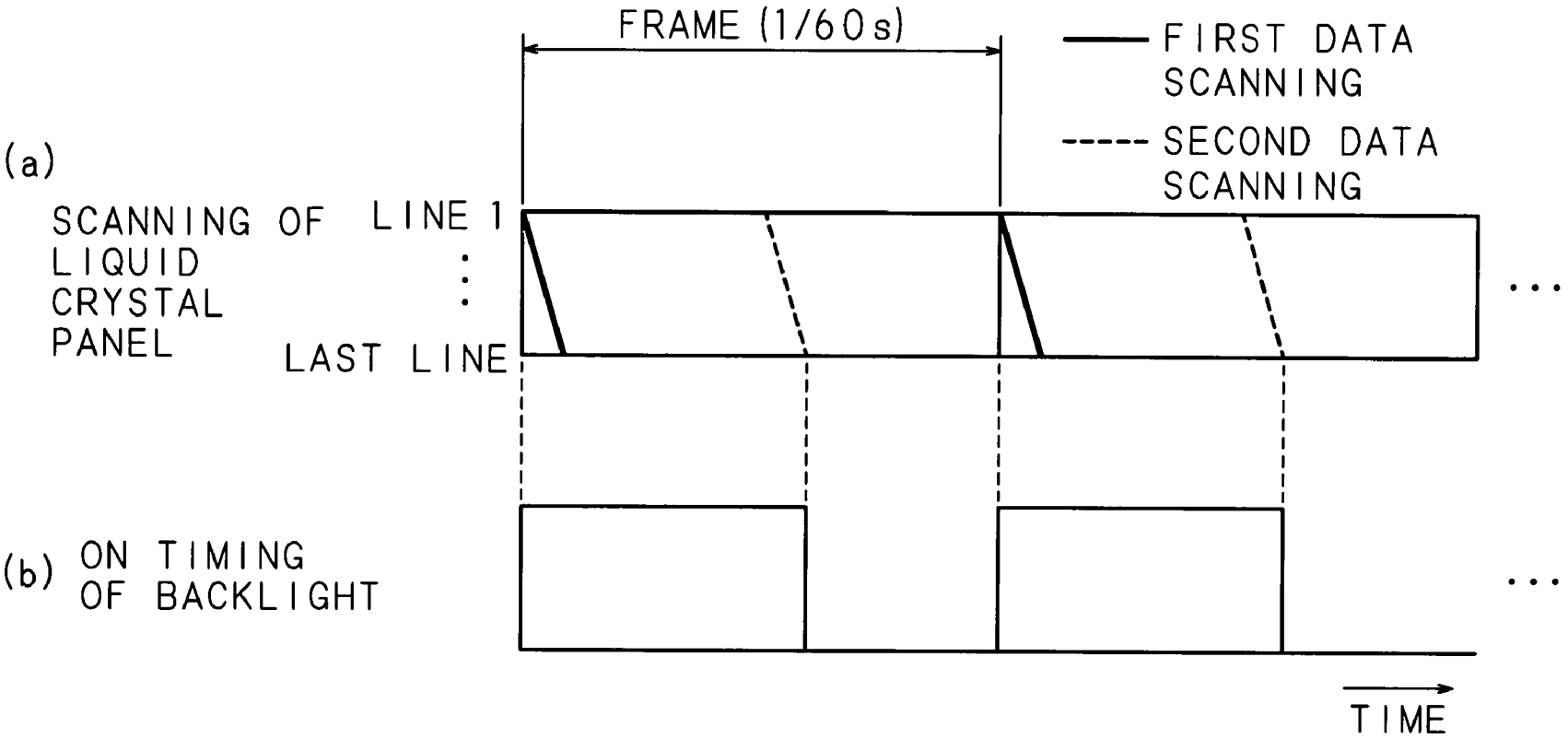
FIG. 10 is a view showing a drive sequence of the liquid crystal display devices of the first and third embodiments.
Figure 11:
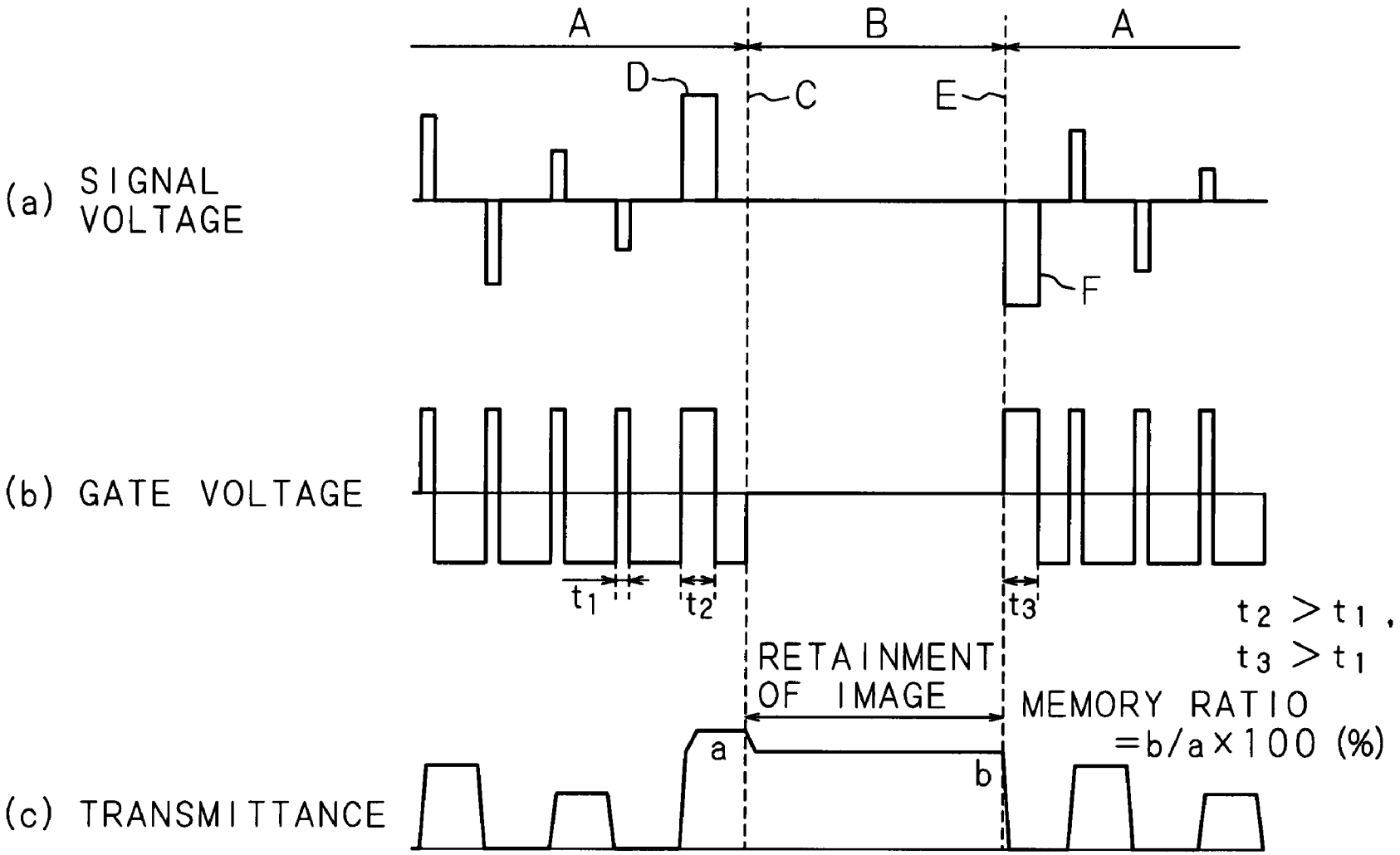
FIG. 11 is a view showing a drive sequence of the liquid crystal display devices of the first and second embodiments.

Next, a specific example of operation of the first embodiment is explained. FIG. 10 and FIG. 11 are timing charts showing one example of a drive sequence in this operation example. FIG. 10(*a*) shows the scanning timing of each line of the liquid crystal panel 1, and FIG. 10(*b*) shows the ON timing of the backlight 30. As shown in FIG. 10(*a*), image data writing scanning is performed twice in each frame on the liquid crystal panel 1. In the first data writing scanning, data writing scanning is performed in one polarity capable of realizing a bright display, and in the second data writing scanning, a voltage with the opposite polarity and substantially equal magnitude to that in the first data writing scanning is applied. Consequently, a darker display is realized compared to the first data writing scanning and practically recognized as a "black image".

FIG. 11(*a*) indicates the magnitude of a signal voltage applied to the ferroelectric liquid crystal to obtain a desired display; FIG. 11(*b*) indicates the gate voltage of the TFT 21, and FIG. 11(*c*) indicates the light transmittance. FIG. 11 shows a drive sequence on a selected line. It is possible to perform the normal display function (period A) that rewrites the displayed image by applying a voltage to the ferroelectric liquid crystal at a predetermined cycle and the memory display function (period B) that stops the application of voltage to the ferroelectric liquid crystal and retains the image displayed before stopping the application of voltage.

After applying a voltage corresponding to a desired image to the ferroelectric liquid crystal on a line-by-line basis at the timing of gate-on voltage, the application of voltage to the liquid crystal panel 1 is stopped at a desired timing after completion of the application of voltage to the last line but before selecting the first line (timing C). However, in the data writing scanning just before stopping the application of voltage, a voltage (signal voltage D) corresponding to image data desired to be kept displayed when no voltage is applied is applied.

In the period (period B) in which a voltage is not applied, the light transmittance is maintained based on the memory function of the ferroelectric liquid crystal, and the displayed image corresponding to the voltage (signal voltage D) applied just before this period is retained. Thereafter, in order to display a different image, the application of voltage to the ferroelectric liquid crystal is resumed (timing E). At this time, after turning all pixels of the liquid crystal panel 1 to display black image, a voltage corresponding to desired display data is applied. In other words, when resuming the application of voltage to the ferroelectric liquid crystal, a voltage (signal voltage F) corresponding to a black image is first applied.

In the first embodiment, the gate selection period ($t_1$) in the data writing scanning on the normal display is set to 5 μs/line, and the gate selection period ($t_2$) in the data writing scanning in the data just before performing the memory display is set to 100 μs/line in order to realize a satisfactory memory display until −10° C. based upon the aforesaid characteristic results (see FIG. 5). At this time, the application time of the signal voltage is also varied in accordance with the gate selection period.

Figure 1:
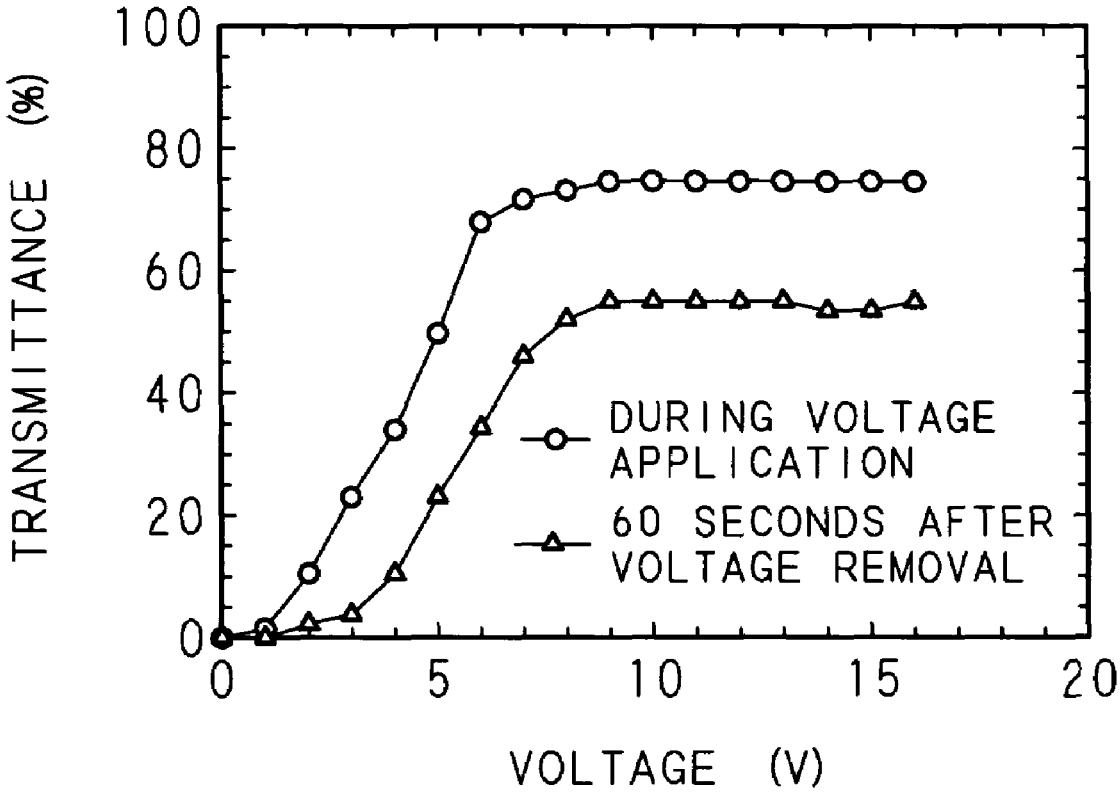
FIG. 1 is a graph showing one example of light transmittance during when a voltage is applied and that during when no voltage is applied.
Figure 2:
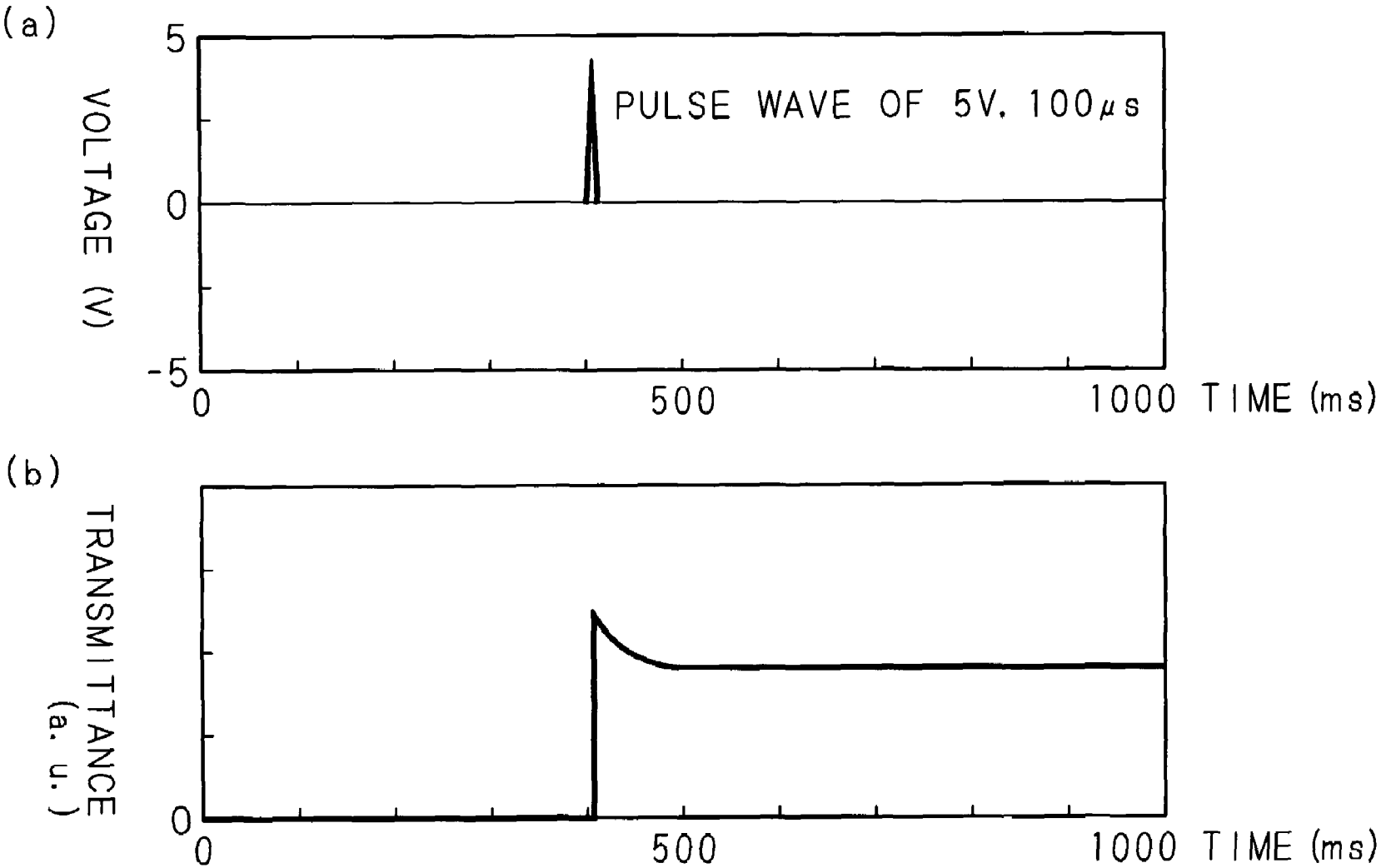
FIG. 2 is a graph showing an example of application of pulse voltage and the resulting change in the light transmittance with time.

According to the drive sequence shown in FIG. 11, a voltage is applied on a line-by-line basis through the switching of the TFTs 21, and all voltages applied to the liquid crystal panel 1 are turned off at a desired timing after completion of the application of voltage to the last line. Further, the light transmittance during the application of voltage and the light transmittance at 60 seconds after the removal of voltage are measured while changing the value of the voltage applied to the liquid crystal panel 1. The measurement results show characteristics similar to FIG. 1 and FIG. 2. Thus, it can be understood that the light transmittance corresponding to the display state when the voltage is applied can be maintained by removing all voltages applied to the liquid crystal panel 1 according to the drive sequence of FIG. 11. As a result, it can be understood that it is possible to display an image without applying a voltage, that is, it is possible to certainly achieve a memory display.

In addition, when resuming the application of voltage to the liquid crystal panel 1, a voltage corresponding to display data is applied to the liquid crystal panel 1 after turning all pixels of the liquid crystal panel 1 to display black image. Consequently, a high-quality color display including a moving-image display can be provided again. When all the displays on the liquid crystal panel 1 are turned into black images, the gate selection period ($t_3$) is set to 100 μs/line to make the time for applying voltage to the liquid crystal longer than that upon the normal display, thereby being capable of surely realizing a display of black image.

Figure 12:
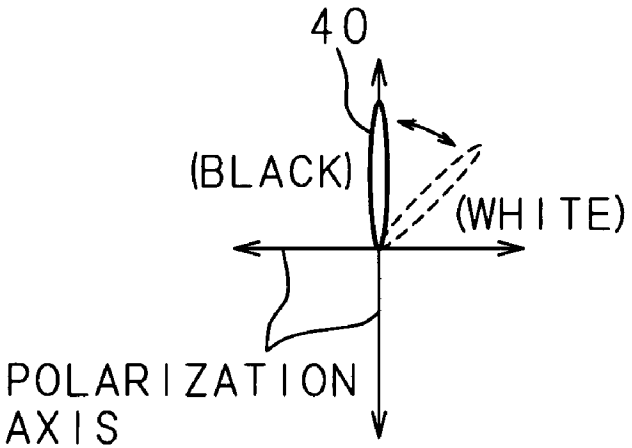
FIG. 12 is a view for explaining a change in light transmittance on a black base.
Figure 12:
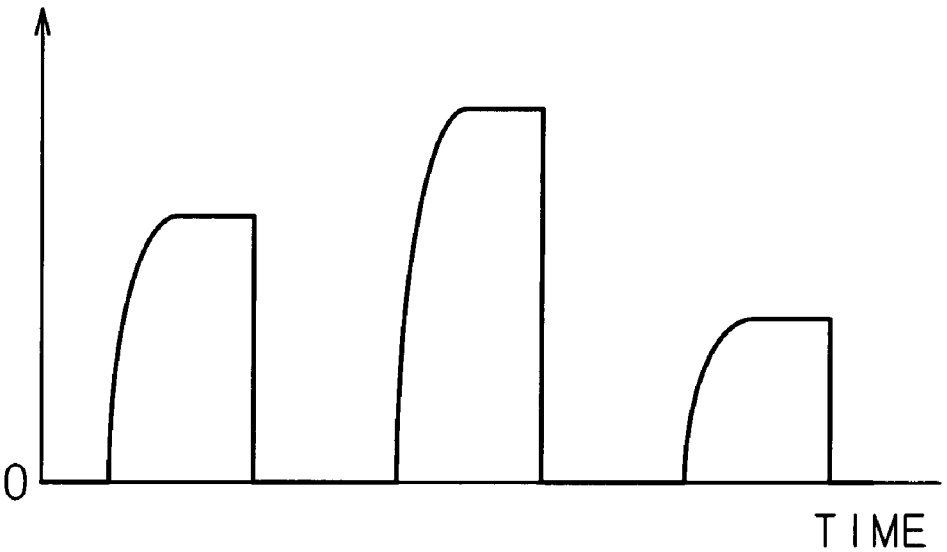
Figure 13:
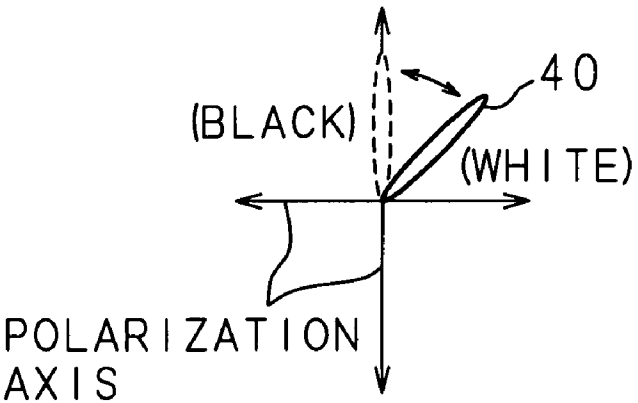
FIG. 13 is a view for explaining a change in light transmittance on a white base.
Figure 13:
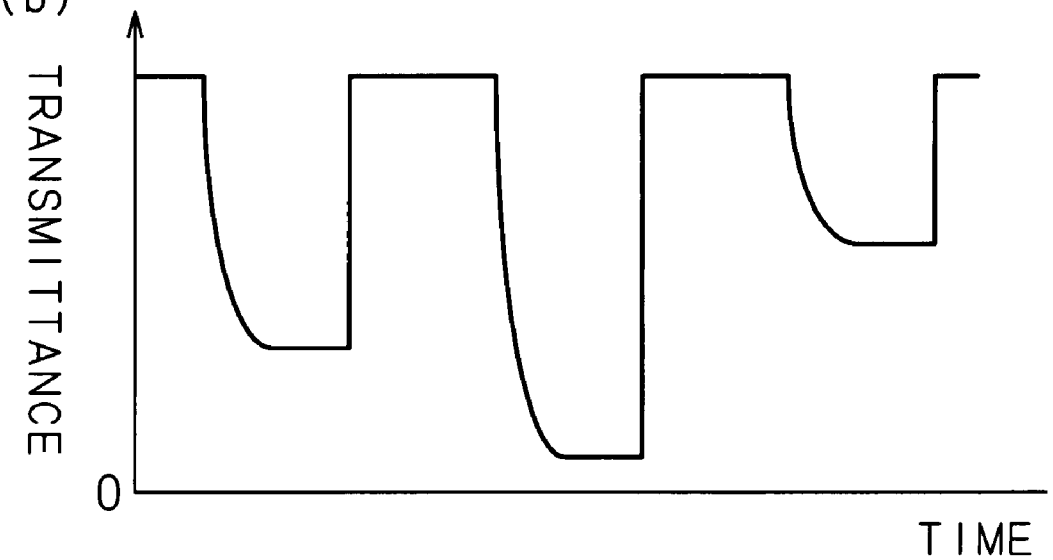

FIG. 12 is a view for explaining a change in light transmittance on a black base. As shown in FIG. 12(*a*), a liquid crystal molecule 40 is initially positioned along a polarization axis (the position of black image shown by the solid line), and changes its orientation between this position and a position shifted from the polarization axis (the position of white image shown by the broken line) according to an applied voltage. One example of the change in the light transmittance at this time is shown in FIG. 12(*b*). On the other hand, FIG. 13 is a view for explaining a change in light transmittance on a white base. As shown in FIG. 13(*a*), the liquid crystal molecule 40 is initially in a position shifted from a polarization axis (the position of white image shown by the solid line), and changes its orientation between this position and a position along the polarization axis (the position of black image shown by the broken line) according to an applied voltage. One example of a change in the light transmittance at this time is shown in FIG. 13(*b*).

When resuming the application of voltage, if a voltage corresponding to desired display data is applied after turning all pixels of the liquid crystal panel 1 to display black image, a black-base image is definitely provided as shown in FIG. 12, and a clear display can be obtained. On the other hand, when resuming the application of voltage, if all pixels of the liquid crystal panel 1 are not caused to display black image once, a problem occurs. For example, if the display retained during when no voltage is applied is an image other than black image, particularly a white image, a white-base image is provided as shown in FIG. 13 by resuming the application of voltage, and consequently the desired display can not be obtained.

The adjustment of the brightness of the backlight 30 is investigated. During the normal voltage application (period A in FIG. 11), a positive voltage and a negative voltage are alternately applied to the liquid crystal. In the case of a ferroelectric liquid crystal having a half-V shaped electro-optic response characteristics, since light is transmitted only when the voltage of one polarity is applied, if the ratio of the positive voltage and negative voltage applied is 1:1, the average brightness is about a half of that when light is transmitted. On the other hand, the brightness when no voltage is applied is always uniform. Therefore, the brightness when no voltage is applied may be sometimes higher than that when a voltage is applied.

In order to solve such a problem, according to the first embodiment, the brightness is adjusted by decreasing the brightness of the backlight 30 when no voltage is applied to about 70% of that in the normal display in synchronism with the removal of applied voltage. Even when such an adjustment is performed, the display brightness is not decreased. This decrease of the brightness of the backlight 30 contributes to a reduction of power consumption and is therefore meaningful. Note that the brightness of the backlight 30 when no voltage is applied can be set arbitrarily, and if a further reduction in the power consumption is desired when no voltage is applied, it is of course possible to decrease the brightness of the backlight 30 to be less than about 70%. After resuming the application of voltage, the brightness of the backlight 30 is returned to the original level.

According to the above-described structures, it is possible to realize the same image display when a voltage is applied and when no voltage is applied. The power consumption during the application of voltage is specifically 2.5 W On the other hand, the power consumption when no voltage is applied is specifically 1.3 W, and thus the power consumption is low.

Second Embodiment

Figure 14:
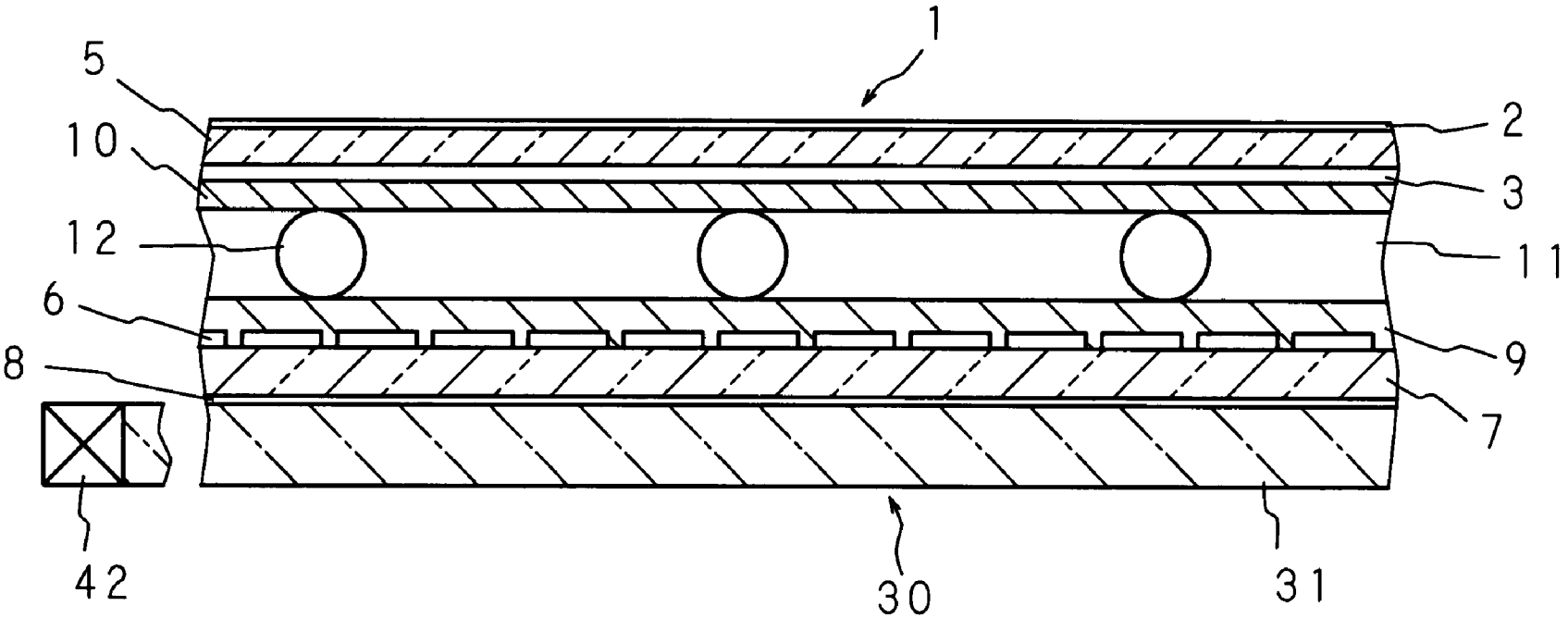
FIG. 14 is a schematic cross sectional view of a liquid crystal panel and backlight of the liquid crystal display devices of the second and fourth embodiments.
Figure 15:
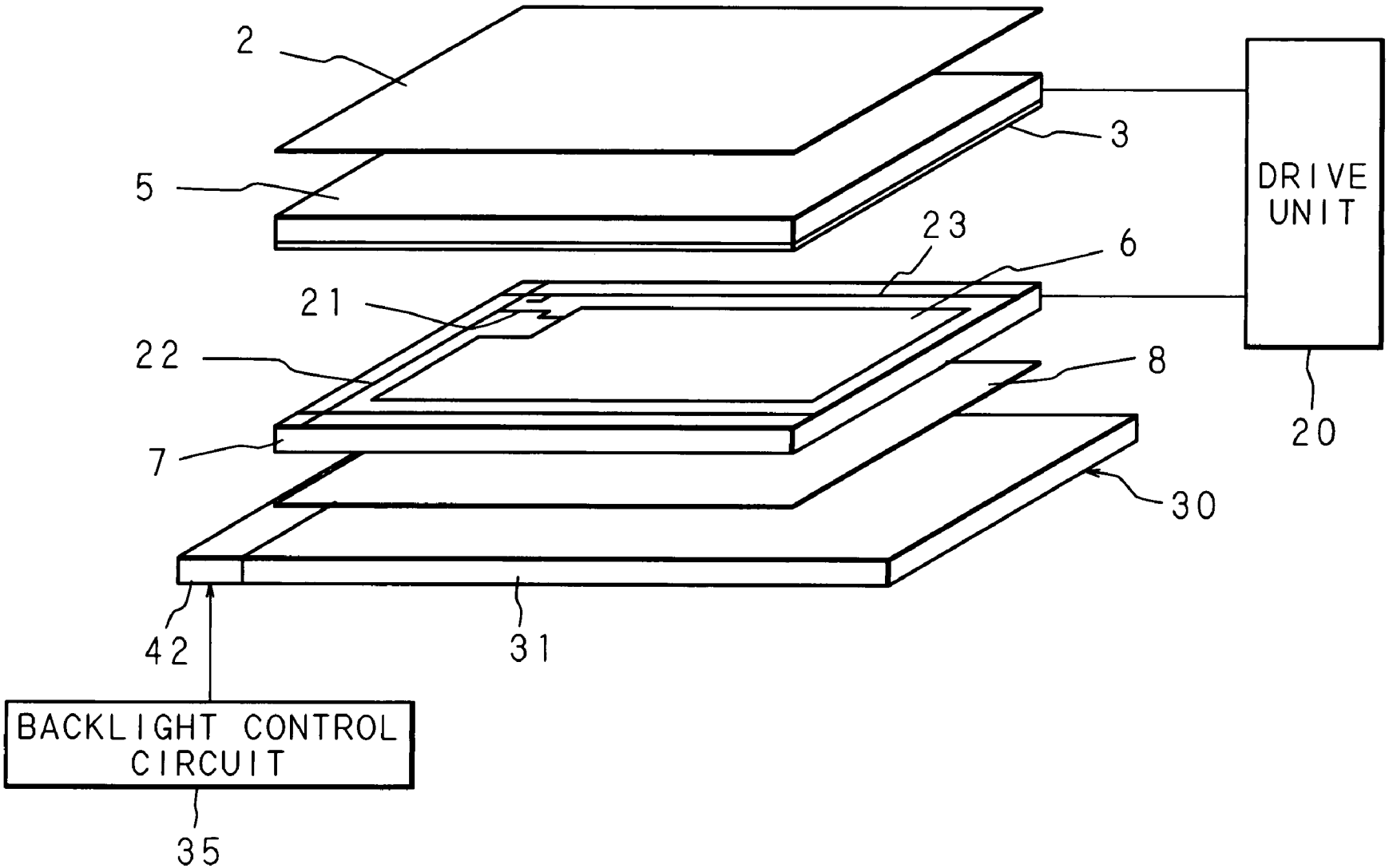
FIG. 15 is a schematic view showing an example of the overall structure of the liquid crystal display devices of the second and fourth embodiments.

FIG. 14 is a schematic cross sectional view of a liquid crystal panel and backlight of the liquid crystal display device according to the second embodiment, and FIG. 15 is a schematic view showing an example of the overall structure of the liquid crystal display device. The second embodiment is a liquid crystal display device for displaying color images by a field-sequential method. In FIGS. 14 and 15, parts that are the same as or similar to those in FIGS. 7 and 8 are designated with the same numbers.

In this liquid crystal panel 1, color filters shown in the first embodiment (FIGS. 7 and 8) are not present. Moreover, the backlight 30 is disposed on the lower layer (rear face) side of the liquid crystal panel 1, and has an LED array 42 placed to face an end face of the light guiding and diffusing plate 31 that forms a light emitting area. This LED array 42 comprises of LEDs, one LED chip being composed of ten LED elements that emit light of the three primary colors, namely red, green and blue, on a face facing the light guiding and diffusing plate 31. The LED array 42 turns on the red, green and blue LED elements in red, green and blue sub-frames, respectively. The light guiding and diffusing plate 31 guides the light emitted from the respective LEDs of the LED array 42 to its entire surface and diffuses the light to the upper face, thereby functioning as the light emitting area.

The liquid crystal panel 1 and the backlight 30 capable of emitting red, green and blue light in a time-divided manner are stacked one upon another. The color of emitted light, ON timing and brightness of the backlight 30 are controlled by a backlight control circuit 35 in synchronism with data writing scanning based on the display data on the liquid crystal panel 1.

A specific example of the liquid crystal display device of the second embodiment is explained. After washing a TFT substrate having pixel electrodes 6 (640×480, 3.2-inch diagonal) and a common electrode substrate having a common electrode 3, they were coated with polyimide and baked for one hour at 200° C. to form an about 200-Å thick polyimide film as alignment films 9 and 10. Further, these alignment films 9 and 10 were rubbed with rayon fabric, and an empty panel was produced by stacking these two substrates while maintaining a gap therebetween by spacers 12 made of silica having an average particle size of 1.6 μm. A liquid crystal layer 11 was formed by sealing a ferroelectric liquid crystal material (for example, a material disclosed in A. Mochizuki, et. al.: Ferroelectrics, 133, 353 (1991)) comprising a naphthalene-based liquid crystal as a main component and showing a half-V shaped electro-optic response characteristics as shown in FIG. 9 during TFT driving. The magnitude of spontaneous polarization of the sealed ferroelectric liquid crystal material was 6 nC/cm$^2$.

The liquid crystal panel 1 was produced by sandwiching the fabricated panel by two polarization films 2 and 8 arranged in a crossed-Nicol state so that a dark state was produced when the long-axis direction of the ferroelectric liquid crystal molecules is tilted in one direction. This liquid crystal panel 1 and the backlight 30 were stacked one upon another to achieve a color display by a filed-sequential method.

Figure 16:
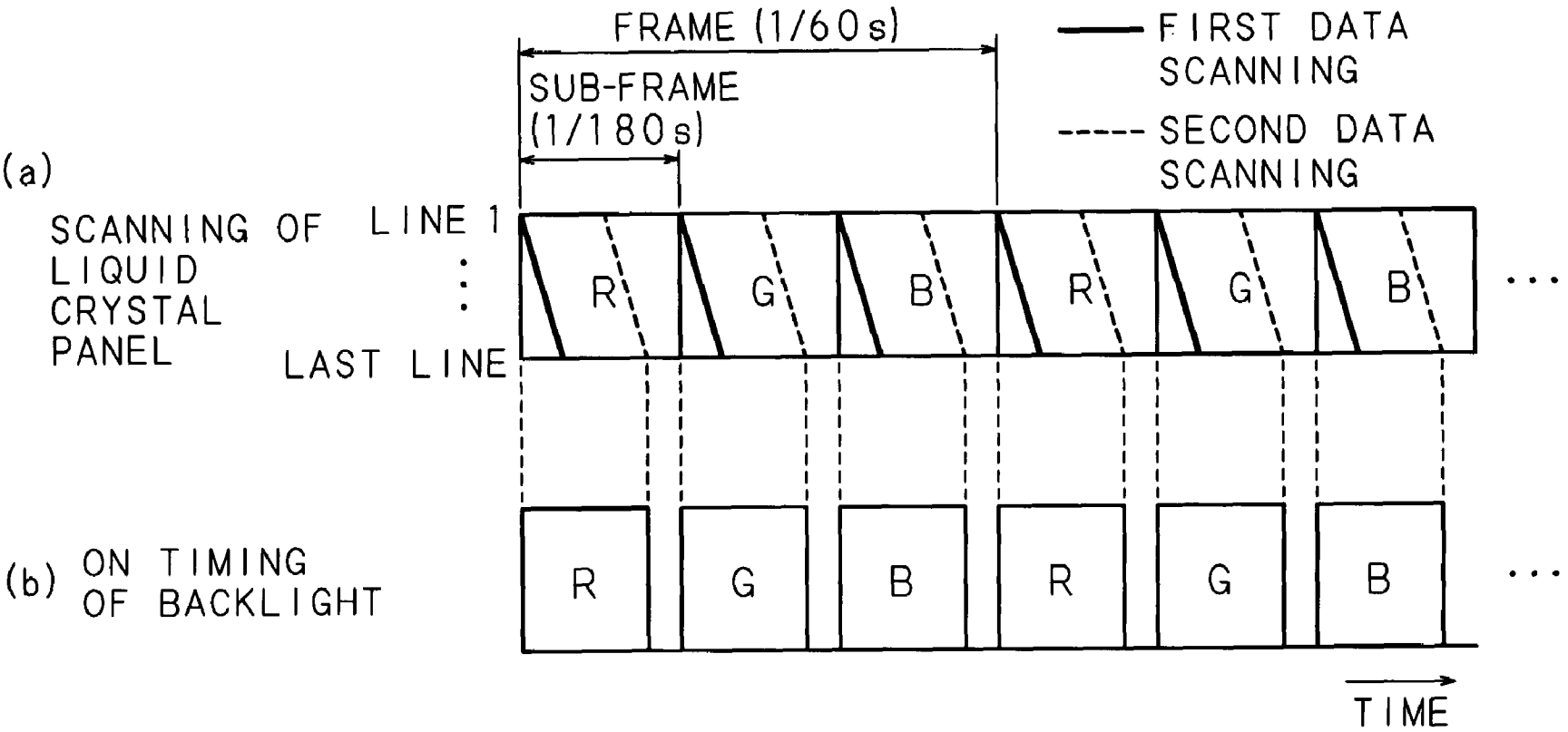
FIG. 16 is a view showing a drive sequence of the liquid crystal display devices of the second and fourth embodiments.

Next, a specific example of operation of the second embodiment is explained. FIG. 16 and FIG. 11 are timing charts showing one example of a drive sequence in this operation example.

FIG. 16(*a*) shows the scanning timing of each line of the liquid crystal panel 1, and FIG. 16(*b*) shows the ON timing of red, green and blue of the backlight 30. One frame is divided into three sub-frames, and, for example, as shown in FIG. 16(*b*), red light is emitted in the first sub-frame, green light is emitted in the second sub-frame, and blue light is emitted in the third sub-frame. On the other hand, as shown in FIG. 16(*a*), image data writing scanning is performed twice in each sub-frame of red, green and blue on the liquid crystal panel 1. In the first data writing scanning, data writing scanning is performed in one polarity capable of realizing a bright display, and in the second data writing scanning, a voltage with the opposite polarity and substantially equal magnitude to that in the first data writing scanning is applied. Consequently, a darker display is realized compared to the first data writing scanning and practically recognized as a "black image".

It should be noted that the drive sequence shown in FIG. 11 is the same as that in the first embodiment, so that the detailed explanation thereof is omitted.

Next, similarly to the first embodiment, a voltage is applied to the liquid crystal through the switching of the TFTs 21 on a line-by-line basis, and all voltages applied to the liquid crystal panel 1 are turned off at a desired timing after completion of the application of voltage to the last line. Data writing scanning performed just before stopping data writing scanning is writing scanning of monochrome display data desired to be displayed when no voltage is applied.

Like the first embodiment, the gate selection period ($t_1$) in the data writing scanning on the normal display is set to 5 μs/line, and the gate selection period ($t_2$) in the data writing scanning just before performing the memory display is set to 100 μs/line. Further, when the voltage application to the liquid crystal panel 1 is resumed, the display of the liquid crystal panel 1 is turned into black images, and thereafter, the voltage corresponding to the display data is applied to the liquid crystal panel 1. When the display of the liquid crystal panel is turned into black images, the gate selection period ($t_3$) is set to 100 μs/line, thereby making the voltage application period to the liquid crystal longer than that upon the normal display. Further, the brightness of the backlight 30 is reduced, compared to that in the normal display, during the memory display.

According to the above-described structures, when a voltage is applied, a high-quality display including a moving-image display is obtained, and when the voltage is removed, a monochrome display is obtained with lower power consumption by switching the backlight 30 to white light adjusted to a desired intensity value. After resuming the voltage application, a high-quality display including a moving-image display can be obtained again. The power consumption during the application of voltage for a color display of a moving image is specifically 1.5 W. On the other hand, the power consumption when no voltage is applied for a monochrome display is specifically 0.53 W, and thus the power consumption is low.

Next, an example in which high memory ratio can surely be realized upon performing the memory display by setting the gate non-selection period (gate-off period) longer than that upon the normal display will be explained as the third and fourth embodiments.

Third Embodiment

The third embodiment is a liquid crystal display device for displaying color images by a color-filter method. The configuration and manufacturing process are the same as those in the aforesaid first embodiment (FIGS. 7 and 8), so that the detailed explanation thereof is omitted.

Figure 17:
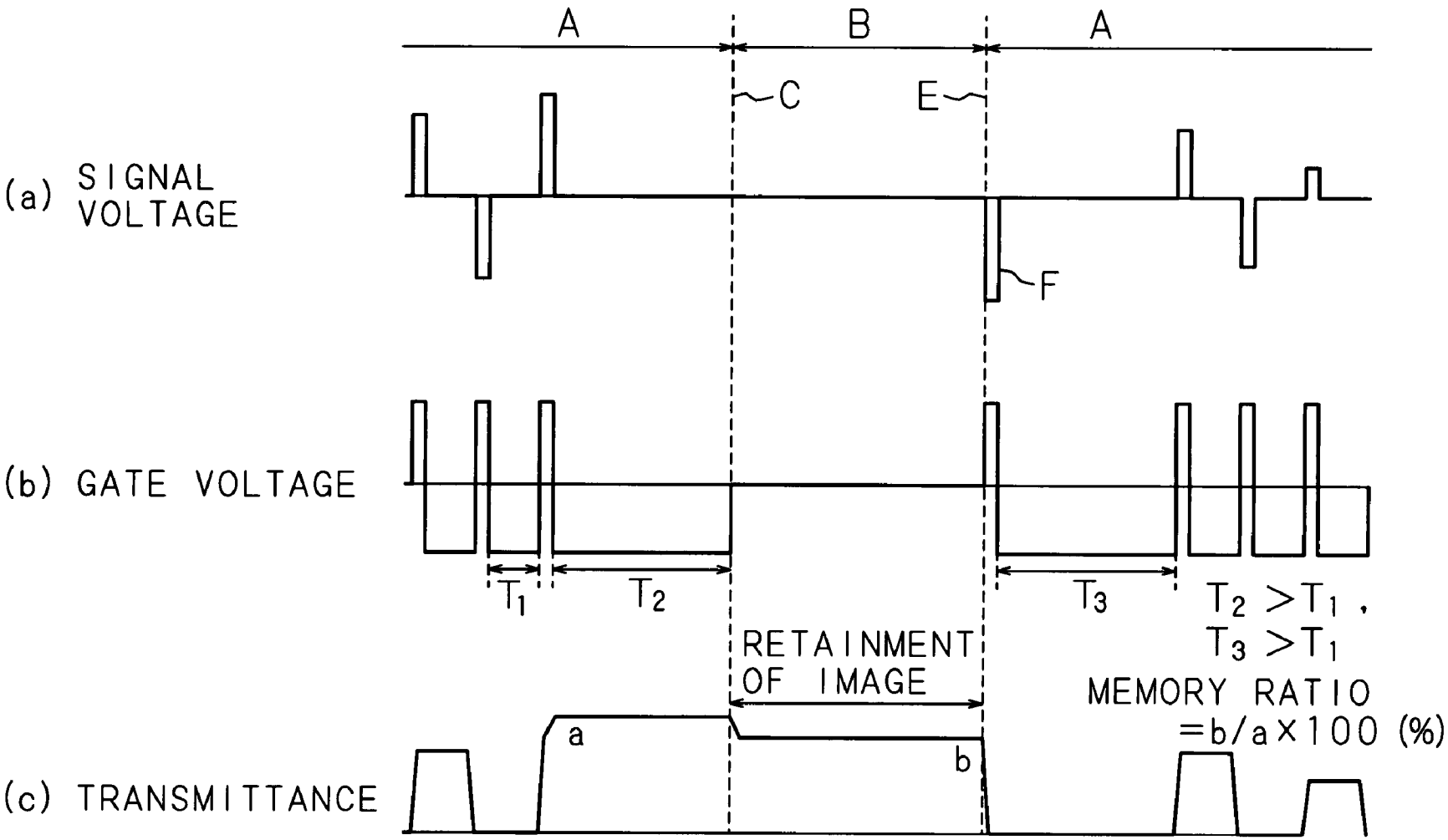
FIG. 17 is a view showing a drive sequence of the liquid crystal display devices of the third and fourth embodiments.

Next, a specific example of operation of the third embodiment is explained. FIG. 10 and FIG. 17 are timing charts showing one example of a drive sequence in this operation example. The drive sequence shown in FIG. 10 is the same as those in the first embodiment.

FIG. 17(*a*) indicates the magnitude of a signal voltage applied to the ferroelectric liquid crystal to obtain a desired display; FIG. 17(*b*) indicates the gate voltage of the TFT 21, and FIG. 17(*c*) indicates the light transmittance. FIG. 17 shows a drive sequence on a selected line. It is the same as the drive sequence shown in FIG. 11 that it is possible to perform the normal display function (period A) that rewrites the displayed image by applying a voltage to the ferroelectric liquid crystal at a predetermined cycle and the memory display function (period B) that stops the application of voltage to the ferroelectric liquid crystal and retains the image displayed before stopping the application of voltage.

In the third embodiment, the gate selection period in the data writing scanning on the normal display is set to 5 μs/line and the gate non-selection (off) period ($T_1$) is set to 8.3 ms, and the gate non-selection (off) period ($T_2$) in the data writing scanning just before performing the memory display is set to not less than 1000 ms in order to realize a satisfactory memory display until −10° C. based upon the aforesaid characteristic results (see FIG. 6). Specifically, all voltages applied to the liquid crystal panel 1 are turned off at 1000 ms after voltage is applied to the last line.

According to the drive sequence shown in FIG. 17, a voltage is applied on a line-by-line basis through the switching of the TFTs 21, and all voltages applied to the liquid crystal panel 1 are turned off at a desired timing after completion of the application of voltage to the last line. Further, the light transmittance during the application of voltage and the light transmittance at 60 seconds after the removal of voltage are measured while changing the value of the voltage applied to the liquid crystal panel 1. The measurement results show characteristics similar to FIG. 1 and FIG. 2. Thus, it can be understood that the light transmittance corresponding to the display state when the voltage is applied can be maintained by removing all voltages applied to the liquid crystal panel 1 according to the drive sequence of FIG. 17. As a result, it can be understood that it is possible to display an image without applying a voltage, that is, it is possible to certainly achieve a memory display.

In addition, when resuming the application of voltage to the liquid crystal panel 1, a voltage corresponding to display data is applied to the liquid crystal panel 1 after turning all pixels of the liquid crystal panel 1 to display black image. Consequently, a high-quality color display including a moving-image display can be provided again. When all the displays on the liquid crystal panel 1 are turned into black images, the gate non-selection (OFF) period ($T_3$) is set to 1000 ms to make the time for applying voltage to the liquid crystal longer than the gate non-selection (OFF) period ($T_1$) upon the normal display, thereby being capable of surely realizing a display of black image. The reason for this is as described in the first embodiment.

The adjustment of the brightness of the backlight 30 is investigated. Like the first embodiment, the brightness when no voltage is applied may be sometimes higher than that when a voltage is applied even in the third embodiment. In order to solve such a problem, the brightness is adjusted by decreasing the brightness of the backlight 30 when no voltage is applied to about 70% of that in the normal display in synchronism with the removal of applied voltage, like the first embodiment.

According to the above-described structures, it is possible to realize the same image display when a voltage is applied and when no voltage is applied. The power consumption during the application of voltage is specifically 2.4 W. On the other hand, the power consumption when no voltage is applied is specifically 1.4 W, and thus the power consumption is low.

Fourth Embodiment

The fourth embodiment is a liquid crystal display device for displaying color images by a field-sequential method. The configuration and manufacturing process are the same as those in the aforesaid second embodiment (FIGS. 14 and 15), so that the detailed explanation thereof is omitted.

Next, a specific example of operation of the fourth embodiment is explained. FIG. 16 and FIG. 17 are timing charts showing one example of a drive sequence in this operation example. The drive sequence shown in FIG. 16 is the same as those in the second embodiment, and the drive sequence shown in FIG. 17 is the same as those in the third embodiment.

Like the third embodiment, a voltage is applied on a line-by-line basis through the switching of the TFTs 21, and all voltages applied to the liquid crystal panel 1 are turned off at a desired timing after completion of the application of voltage to the last line. Data writing scanning performed just before stopping data writing scanning is writing scanning of monochrome display data desired to be displayed when no voltage is applied.

Like the third embodiment, the gate non-selection period ($T_1$) in the data writing scanning on the normal display is set to 2.8 ms, and the gate non-selection period ($T_2$) in the data writing scanning just before performing the memory display is set to not less than 1000 ms. Further, when the voltage application to the liquid crystal panel 1 is resumed, the display of the liquid crystal panel 1 is turned into black images, and thereafter, the voltage corresponding to the display data is applied to the liquid crystal panel 1. When the display of the liquid crystal panel is turned into black images, the gate non-selection period ($T_3$) is set to 1000 ms, thereby making the voltage application period to the liquid crystal longer than that upon the normal display. Further, the brightness of the backlight 30 is reduced, compared to that in the normal display, during the memory display.

According to the above-described structures, when a voltage is applied, a high-quality display including a moving-image display is obtained, and when the voltage is removed, a monochrome display is obtained with lower power consumption by switching the backlight 30 to white light adjusted to a desired intensity value. After resuming the voltage application, a high-quality display including a moving-image display can be obtained again. The power consumption during the application of voltage for a color display of a moving image is specifically 1.3 W. On the other hand, the power consumption when no voltage is applied for a monochrome display is specifically 0.51 W, and thus the power consumption is low.

Fifth Embodiment

Figure 18:
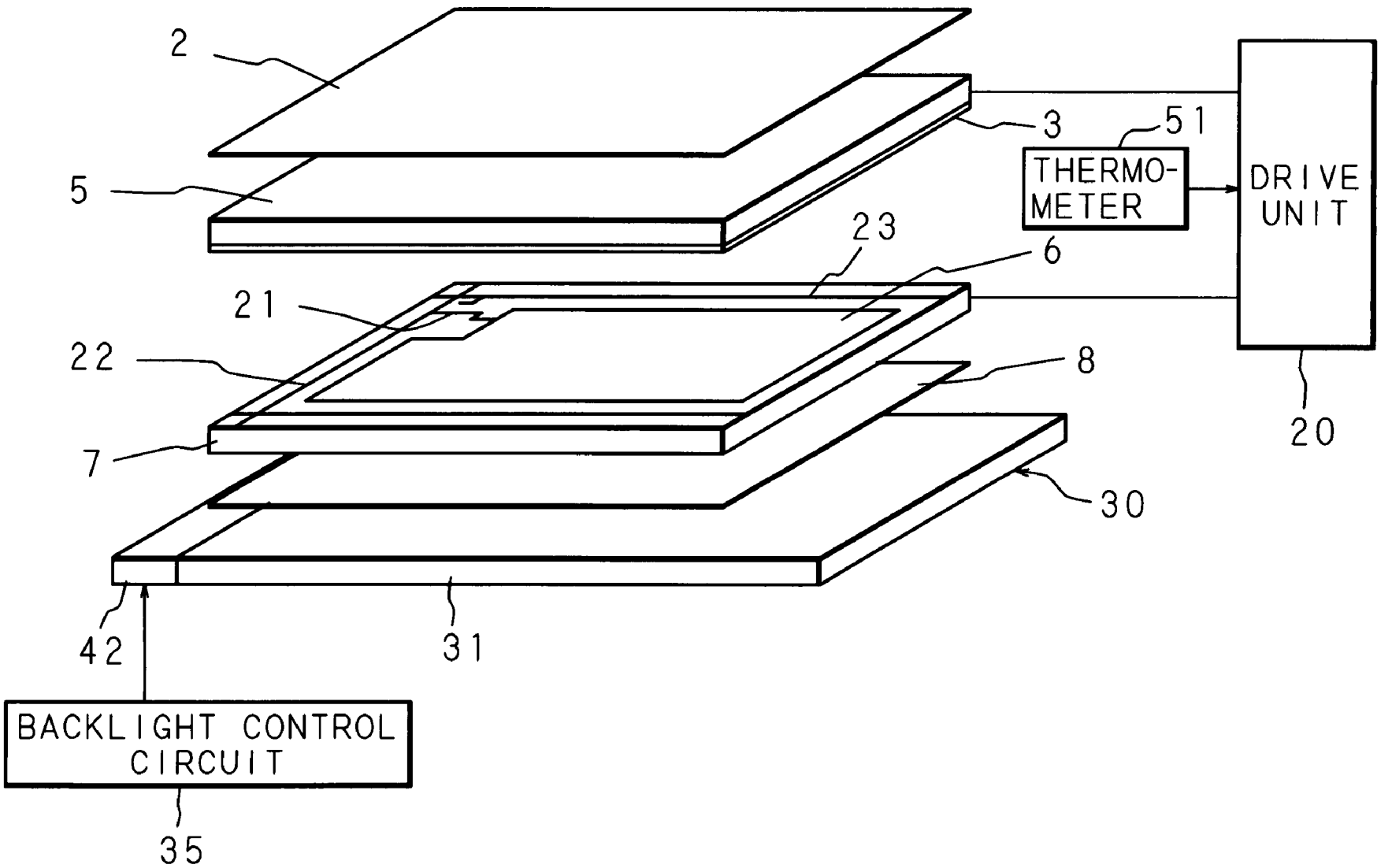
FIG. 18 is a schematic view showing an example of the overall structure of the liquid crystal display devices of the fifth and sixth embodiments.

FIG. 18 is a schematic view showing an example of the overall structure of the liquid crystal display device of the fifth embodiment. In FIG. 18, the same parts as in FIG. 15 are designated with the same numbers, and the explanation thereof is omitted.

In FIG. 18, numeral 51 represents a thermometer for measuring a temperature of the liquid crystal panel 1. The thermometer 51 outputs the measured temperature to the drive unit 20. The drive unit 20 has a first driving system and a second driving system, wherein either one of the first driving system and the second driving system is selected according to the temperature measured by the thermometer 51. Specifically, in case where the temperature is 20° C. or below, the driving system is changed to the first driving system, while in case where it is higher than 20° C., the driving system is changed to the second driving system.

Figure 19:
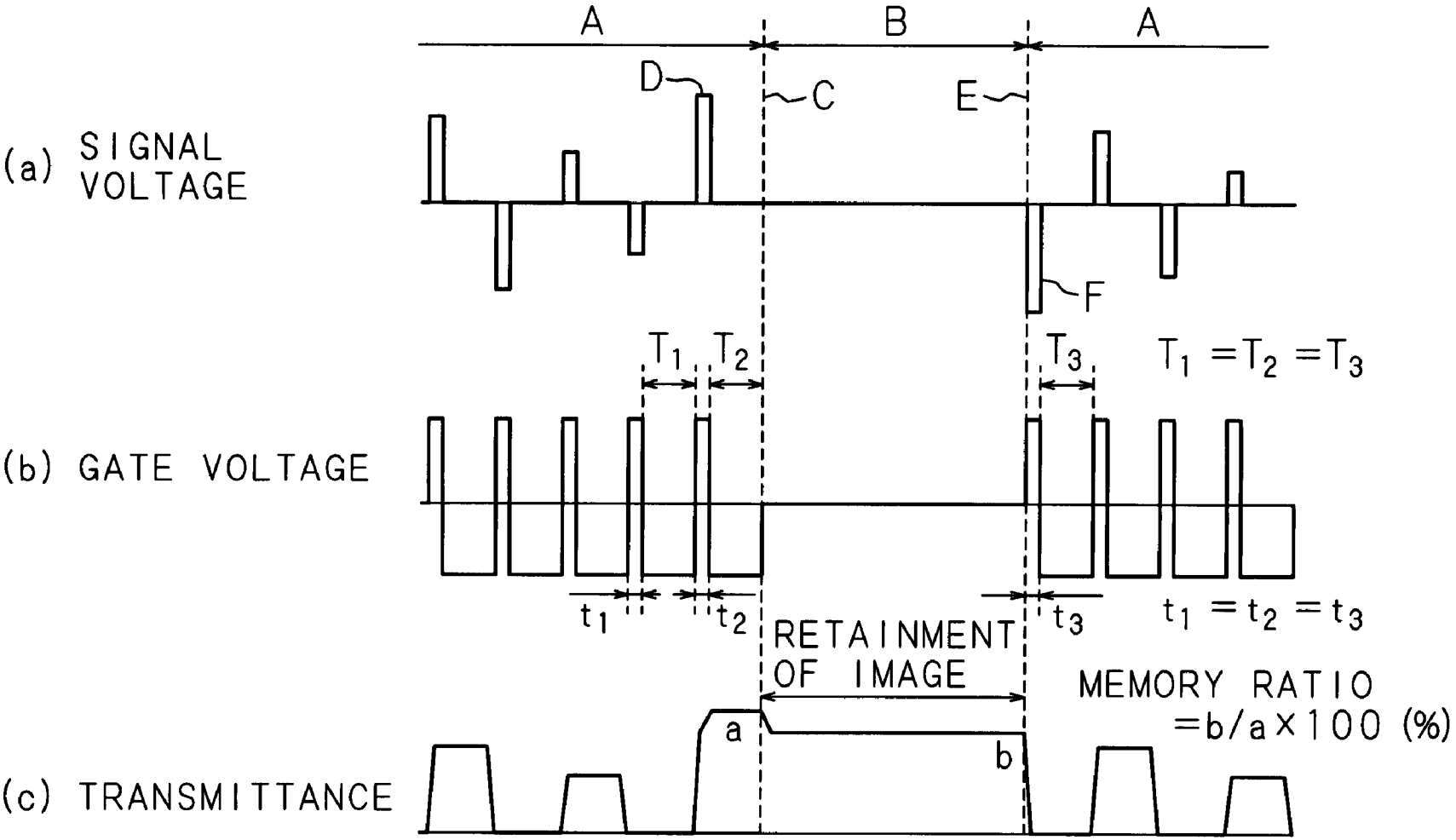
FIG. 19 is a view showing a drive sequence that can be changed over in the liquid crystal display devices of the fifth and sixth embodiments.

The first driving system is the one in which the gate selection period (the voltage application period to the liquid crystal material: $t_2$) just before stopping the voltage application for executing the memory display function is longer than the gate selection period (the voltage application period to the liquid crystal material: $t_1$) in the normal display ($t_2>t_1$) as shown in FIG. 11. The second driving system is the one in which the gate selection period (the voltage application period to the liquid crystal material: $t_2$) just before stopping the voltage application for executing the memory display function is equal to the gate selection period (the voltage application period to the liquid crystal material: $t_1$) in the normal display ($t_2=t_1$) as shown in FIG. 19.

In the fifth embodiment, in case where the temperature is 20° C. or below, high memory ability cannot be provided during the gate selection period (voltage application period to the liquid crystal material) equal to that in the normal display, so that the driving system is changed to the first driving system to realize high memory ability. On the other hand, in case where the temperature is higher than 20° C., high memory ability can be provided even in the gate selection period (voltage application period to the liquid crystal material) equal to that in the normal display, so that the driving system is changed to the second driving system to thereby reducing power consumption.

Sixth Embodiment

The overall structure of the liquid crystal display device according to the sixth embodiment is the same as that in the fifth embodiment (FIG. 18). The thermometer 51 outputs the measured temperature to the drive unit 20. The drive unit 20 has the first driving system and the second driving system.

The first driving system is the one in which the gate non-selection period (gate-off period: $T_2$) just before stopping the voltage application for executing the memory display function is longer than the gate non-selection period (gate-off period: $T_1$) in the normal display ($T_2>T_1$) as shown in FIG. 17. The second driving system is the one in which the gate non-selection period (gate-off period: $T_2$) just before stopping the voltage application for executing the memory display function is equal to the gate non-selection period (gate-off period: $T_1$) in the normal display ($T_2=T_1$) as shown in FIG. 19.

In the sixth embodiment, in case where the temperature is 20° C. or below, high memory ability cannot be provided during the gate non-selection period (gate-off period) equal to that in the normal display, so that the driving system is changed to the first driving system to realize high memory ability. On the other hand, in case where the temperature is higher than 20° C., high memory ability can be provided even in the gate non-selection period (gate-off period) equal to that in the normal display, so that the driving system is changed to the second driving system to thereby reducing power consumption.

In the fifth and sixth embodiments, a field-sequential type liquid crystal display device is explained as one example, but the aforesaid technique for switching the drive sequence according to the temperature can of course be applied to a color-filter type liquid crystal display device shown in FIGS. 7 and 8.

Although the aforesaid embodiments explain about a transmission type liquid crystal display device, the present invention can of course be applied similarly to a reflection type or semi-transmission type liquid crystal display device. A display is possible in a reflection type or semi-transmission type liquid crystal display device without using a light source such as a backlight. Therefore, it is possible to bring power consumption close to the vicinity of zero as much as possible by the combination with the memory display function.

INDUSTRIAL APPLICABILITY

As described in detail, a memory display function can surely be performed within a wide temperature range according to the present invention. Further, a driving system is switched according to need, thereby being capable of providing high memory ability and reducing power consumption.

The invention claimed is:

1. A liquid crystal display device comprising a liquid crystal material sealed in a gap formed by at least two substrates; and switching elements corresponding to respective pixels, for controlling selection/non-selection of voltage application to control light transmittance of the liquid crystal material, and having a first display function that displays an image by applying a voltage to the liquid crystal material through the switching elements, and a second display function that stops the application of voltage to the liquid crystal material through the switching elements and retains a display state just before the application of voltage is stopped, wherein an image display is performed by carrying out a switching between a first driving system in which a selection period of the switching elements just before the stop of the application of voltage for executing the second display function is longer than a selection period of the switching elements in the first display function and a second driving system in which the selection period of the switching elements just before the stop of the application of voltage for executing the second display function is equal to the selection period of the switching elements in the first display function.

2. The liquid crystal display device according to claim 1, further comprising measuring means for measuring a temperature of the liquid crystal display material and means for controlling the switching between the first driving system and the second driving system according to the measured results of the measuring means.

* * * * *